US005715932A

United States Patent [19]

Motoyama et al.

[11] Patent Number: 5,715,932

[45] Date of Patent: Feb. 10, 1998

[54] KEY SWITCH

[75] Inventors: Hideyuki Motoyama; Goro Watanabe; Takehiko Sato, all of Kanagawa, Japan

[73] Assignee: Fujitsu Limited, Kawasaki, Japan

[21] Appl. No.: 713,890

[22] Filed: Sep. 17, 1996

[30] Foreign Application Priority Data

Mar. 19, 1996 [JP] Japan ..... 8-063091

[51] Int. Cl.[6] ..... H01H 13/14

[52] U.S. Cl. ..... 200/521; 200/520; 200/345

[58] Field of Search ..... 200/345, 341, 200/517, 512, 520, 521, 539, 530, 471, 470, 472

[56] References Cited

U.S. PATENT DOCUMENTS 3,121,777 2/1964 Gallas ..... 200/521

4,079,220 3/1978 Wagner et al. ..... 200/530

5,012,056 4/1991 Abel et al. ..... 200/539

*Primary Examiner*—David J. Walczak

*Attorney, Agent, or Firm*—Armstrong, Westerman, Hattori, McLeland & Naughton

[57] ABSTRACT

A key switch is provided which includes a key top which is pressed down by optional force and which can move in the press-down direction. The key switch also includes a spring for generating a rebound according to the optional force applied to the key top. The key switch also includes a housing having an elastic member which generates the press-down force against the rebound according to a distance by which the key top moves. The key switch realizes the press-down characteristics in which the inclination of the rebound is zero or negative.

11 Claims, 27 Drawing Sheets

DEVELOPMENT OF GROOVE OF ROTATING PORTION

SECTIONAL SHAPE
OF GROOVE A-A', C-C'

SECTIONAL SHAPE
OF GROOVE B-B', D-D'

SPRING + RUBBER CUP

RUBBER CUP

SPRING

CONSTANT REBOUND
(INCLINATION : ZERO)

DECREASED REBOUND
(NEGATIVE INCLINATION)

DECREASED REBOUND
+ SENSE OF CLICK
(NEGATIVE INCLINATION)

KEY SWITCH

BACKGROUND OF THE INVENTION

1. Field of the Invention

The present invention relates to a key switch, and more particularly to a key switch which is suitably used for a keyboard switch and an operation switch of a word processor, a computer, a measuring apparatus and the like.

2. Description of the Related Art

Recently, a key switch, a keyboard and the like which act as an I/O for transmitting human intention to an information apparatus have become important more and more with the spread of the information apparatus. In particular, a keyboard having a plurality of key switches arranged is the mainstream of input means to the information apparatus. Furthermore, a good feeling of touch has been required for the key switch and the keyboard with the trend that importance is attached to a man machine interface. Thus, a key switch having a good feeling of operation which matches personal sensitivity has been desired still more.

FIG. 25 shows an example of the structure of a key switch according to the prior art. A membrane sheet which acts as a switch element 6 is provided on a support panel 7 made of an iron plate or the like. A housing 4 is provided on the switch element 6. A slider 2 and a spring 5 are inserted in the housing 4. A key top 1 for driving the slider 2 is provided on the slider 2.

When the key top 1 is pressed down, the lower end of the slider 2 pushes the membrane sheet 6 to close a contact. The membrane sheet 6 has a structure in which two sheets having a plurality of contacts printed thereon are disposed through a sheet for a spacer that has holes in positions corresponding to the contacts. When the contact is closed, an electric signal is generated. The electric signal is converted into a digital signal to be sent to an electronic circuit.

By changing a distance by which the key top 1 is pressed down, the strength of force (spring strength) which presses down the spring 5 and the like, various feelings of touch can be obtained.

In general, the feeling of touch is expressed by the force received by means of fingers (rebound) with respect to a distance (stroke) by which the key is pressed down, which will be hereinafter referred to as press-down characteristics.

FIGS. 26A, 26B and 26C show the typical press-down characteristics of the key switch structure shown in FIG. 25 according to the prior art. FIG. 26A shows that a rebound is increased straight by the force of the spring 5. FIG. 26B shows the curved press-down characteristics (Smooth-Snap Touch) obtained in the case where a bowl-shaped rubber which is referred to as a rubber cup is used in place of the spring.

FIG. 26C shows the press-down characteristics (Sharp-Snap Touch) having the rapid change of the rebound (a sense of click) which can be realized by the combination of the spring 5 and the rubber cup.

Thus, the feeling of touch has been variously invented depending on the press-down characteristics including the sense of click together with the stroke and the spring strength. However, the feeling of touch which is suitable depends on personal tastes. Some people like hard touch, and some people like soft touch. Furthermore, some people like no sense of click because they feel that the sense of click which transmits input through fingers is bothersome.

According to the investigations of the press-down characteristics of the key switch which has used a lot of subjects in the prior art, it has been supposed that the press-down characteristics shown in FIGS. 27A, 27B and 27C are ideal.

It has been supposed that the following can give comfortable key stroke. More specifically, there is a proper initial pressure for reducing shaky keys. As shown in FIG. 27A, a rebound applied to the key top is constant without depending on stroke positions (the inclination of the rebound is zero). As shown in FIG. 27B, the rebound applied to the key top is decreased as the key top is pressed down (the inclination of the rebound is negative). As shown in FIG. 27C, the rebound applied to the key top is decreased and the sense of click is obtained in some positions (the inclination of the rebound is negative and the sense of click).

In some key switches using the spring and the rubber cup according to the prior art, the sense of click is felt and the rebound is temporarily negative. However, it is impossible to realize the ideal press-down characteristics in which the inclination is constantly zero or negative as shown in FIGS. 27A, 27B and 27C.

SUMMARY OF THE INVENTION

The present invention provides a key switch comprising press-down means which is pressed down by optional force and can move in the press-down direction, rebound generating means for generating a rebound on the press-down means according to the optional force applied to the press-down means, and press-down force generating means for generating the press-down force which resists the rebound according to a distance by which the press-down means moves.

According to the key switch of the present invention, the inclination of the rebound of the press-down characteristics of the key switch is zero or negative. In addition, the press-down characteristics having a sense of click can be realized. Consequently, key stroke can be performed comfortably.

BRIEF DESCRIPTION OF THE DRAWINGS

The present invention will be detailed in conjunction with the accompanying drawings in which.

DESCRIPTION OF THE PREFERRED EMBODIMENTS

Figure 1:
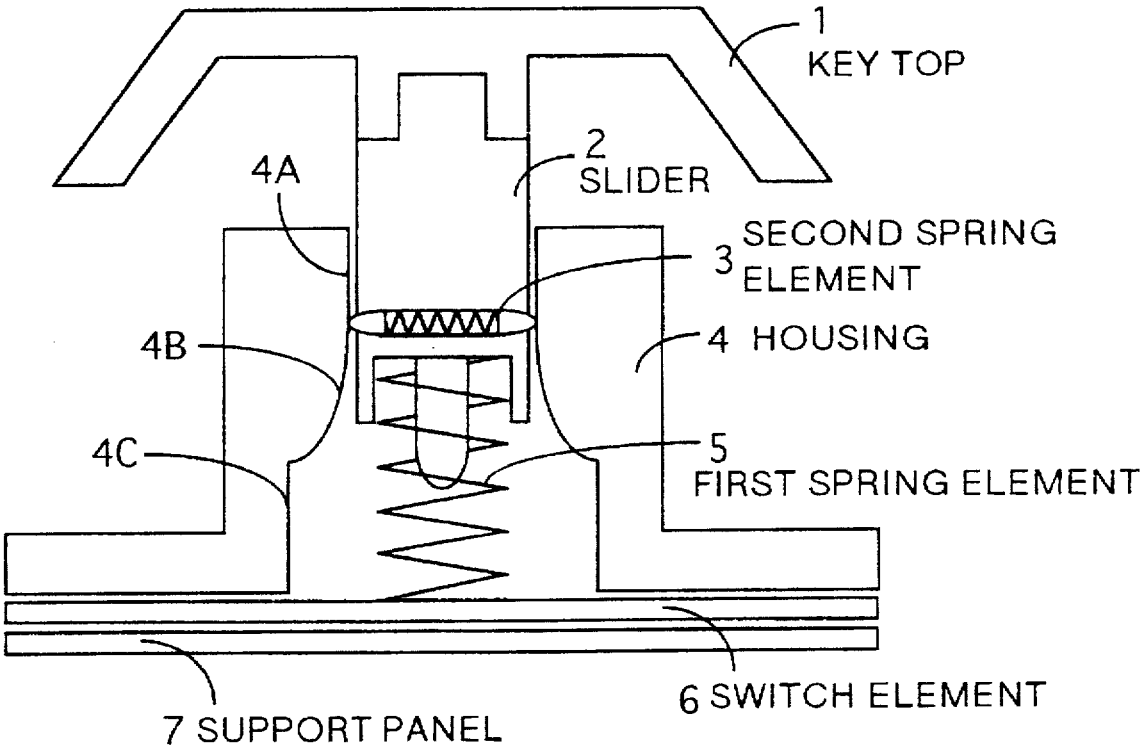
FIG. 1 is a sectional view showing the structure of a key switch according to a first embodiment of the present invention.

The present invention provides a key switch comprising press-down means which is pressed down by optional force and can move in the press-down direction, rebound generating means for generating a rebound on the press-down means according to the optional force applied to the press-down means, and press-down force generating means for generating the press-down force which resists the rebound according to a distance by which the press-down means moves.

The press-down force generating means may be adjusted in such a manner that the rebound generated by the rebound generating means is constant irrespective of the distance by which the press-down means moves. In addition, the press-down-force generating means may be adjusted, in such a manner that the rebound generated by the rebound generating means is decreased as the press-down means is pressed down, or the rebound generated by the rebound generating means is decreased as the press-down means is pressed down and the rate of decrease in the rebound is changed in a predetermined position to which the press-down means is pressed down if the press-down means is pressed to the predetermined position.

Furthermore, the present invention provides a key switch wherein the press-down force generating means includes a key fixing member provided with an opening which has an inclined face whose inner diameter is increased in the press-down direction of the press-down means and in which the press-down means is inserted, and an elastic member which is attached to the press-down means, and internally comes in contact with the opening to generate the force which pushes the internal wall of the opening in the direction almost perpendicular to the press-down direction.

The elastic member may be formed by a compression spring and caps attached to both ends of the compression spring.

In respect of sliding properties, it is preferable that the cap should be made of a polyacetal resin.

The elastic member may be a rubber material, a leaf spring or a torsion spring.

Furthermore, the present invention provides a key switch wherein the key fixing member has a concave portion which surrounds the internal wall of the opening like a zigzag, the elastic member internally comes in contact with the opening in the concave portion, and the key fixing member rotates when the press-down means is pressed down so that the elastic member moves in the press-down direction.

The press-down means may include, in a lower portion thereof, an inclined side whose outer diameter is increased in the press-down direction of the press-down means, and the press-down force generating means may include a key fixing member having an opening whose inner diameter is constant in parallel with the press-down direction and in which the press-down means is inserted, and an elastic member which is attached to the key fixing member and which externally comes in contact with the inclined side of the press-down means to generate the force which pushes the inclined side in the direction almost perpendicular to the press-down direction.

The press-down means is a key top having a face with which fingers actually come in contact in a keyboard and the like.

Ordinarily, the key top extends in the press-down direction or a slider to aid the press-down is bonded under the key top in order to eliminate shaky keys when pressing down the key top. In other words, the press-down means can be formed by the key top and the slider. A material such as ABS is used for the key top. A material such as polyacetal is used for the slider.

In the keyboard and the like, the slider is inserted in the opening of the key fixing member (generally referred to as a housing) which is formed on the central portion thereof.

It is sufficient that the rebound generating means is a so-called elastic member, for example, a compression spring, a leaf spring, a rubber cup, a torsion spring and the like which are not restricted.

An example of the rubber material that is used as the rubber cup is a silicone rubber.

The rebound generating means is inserted in the opening of the housing. The slider presses the rebound generating means downward so that the rebound generating means generates a rebound upward.

The press-down force generating means comprises the housing and an elastic member for generating the force which pushes the internal wall of the opening in the direction almost perpendicular to the press-down direction.

In order to generate the press-down force against the rebound, the inner diameter of the opening of the housing should be formed in such a manner that an upper portion is smaller and a lower portion is larger in the press-down direction. In other words, the internal wall on which the opening is formed has an inclination that is expanded in the press-down direction.

As the key top is pressed down, the elastic member pushes the inclined internal wall so that the press-down force is generated against the rebound.

Similarly to the rebound generating means, the elastic member may be a compression spring, a leaf spring, a rubber cup, a torsion spring and the like which are not restricted.

By properly adjusting the force by which the elastic member pushes the internal wall and an inclination of the internal wall in the press-down direction, the rebound can be kept constant irrespective of a distance by which the press-down means moves by press-down.

By adjusting the force by which the elastic member pushes the internal wall and the inclination in the same manner, the rebound can be decreased as the press-down means is pressed down.

In the case where the rebound is decreased and the press-down means moves to a predetermined position as the press-down means is pressed down, the inclination of the inclined face of the internal wall should be varied in a predetermined position of the internal wall in order to change the rate of decrease in the rebound.

The present invention will be described in detail based on the preferred embodiments with reference to the drawings. The present invention should not be construed as being limited by the following embodiments.

FIRST EMBODIMENT

FIG. 1 is a sectional view showing the structure of a key switch according to a first embodiment of the present invention.

In FIG. 1, a membrane sheet is provided as a switch element 6 on a support panel 7 made of an iron plate or the like, which is the same as in the prior art.

Furthermore, the key switch comprises a housing 4 for fixing a key, a slider 2 inserted in the housing 4, a second spring element 3 inserted in the slider 2, a key top 1 for driving the slider 2, and a first spring element 5 on the inside of the housing 4.

The housing 4 is fixed onto the switch element 6 and has a cylindrical opening in a central portion to insert the slider 2 therein, for example. The inner diameter of the cylindrical opening is not constant but is varied in the vertical direction in which the slider 2 is pressed down as shown in FIG. 1.

In other words, the cylindrical opening has such an inclination that the inner diameter is gradually increased downward in the press-down direction. It is sufficient that only an internal wall portion 4B of the opening has an inclination. The second spring element 3 passes through the internal wall portion 4B when the key top 1 is pressed down. Other internal wall portions (4A, 4C) may be parallel with the press-down direction of the key top 1. In FIG. 1, the internal wall portion 4B has a curved inclination expressed by Equation (9) which will be described below.

For example, a compression spring, a coil spring or a rubber cup is used for the first spring element 5 in the same manner as in the prior art.

The second spring element 3 includes a compression spring and caps which are attached to both ends of the compression spring to internally come in contact with the opening of the housing. The second spring element 3 itself is attached under the slider 2 by pressure, fitting or the like.

Figure 3:
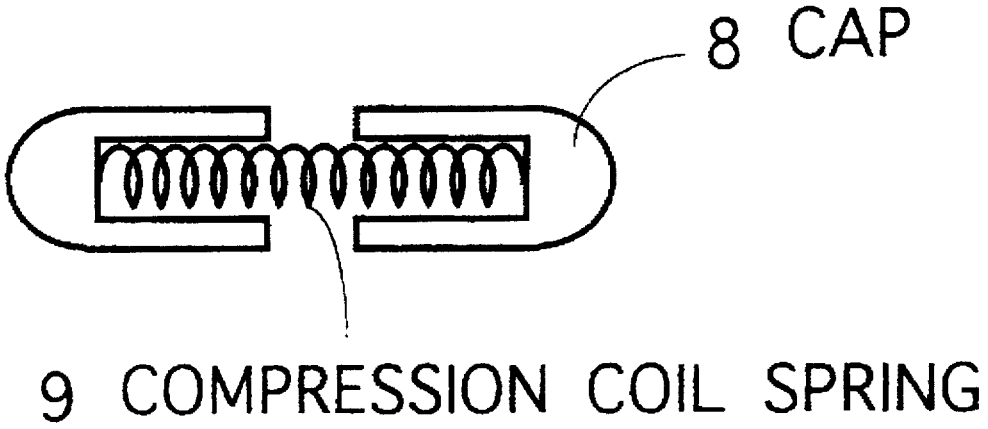
FIG. 3 is a view showing an example of the structure of a second spring element 3 according to the first embodiment of the present invention.

FIG. 3 shows a specific example of the structure of the second spring element 3.

It is preferable that a compression coil spring should be used for the compression spring. In addition, a rubber spring may be used for the compression spring. It is preferable that a polyacetal resin which is hard and has good sliding properties should be used for the cap. In order to utilize moderate friction, rubber caps may be used. If the rubber resins are used for the compression spring and the cap, they can be molded integrally.

When the key top 1 is not pressed down, the second spring element 3 is usually compressed to internally come in contact with the internal wall having a comparatively small inner diameter of the opening of the housing 4 as shown in FIG. 1. The internal wall portion with which the second spring element 3 is in internal contact has a constant inner diameter.

The second spring element 3 presses the internal wall having a constant inner diameter by horizontal force in the compression state.

Figure 2:
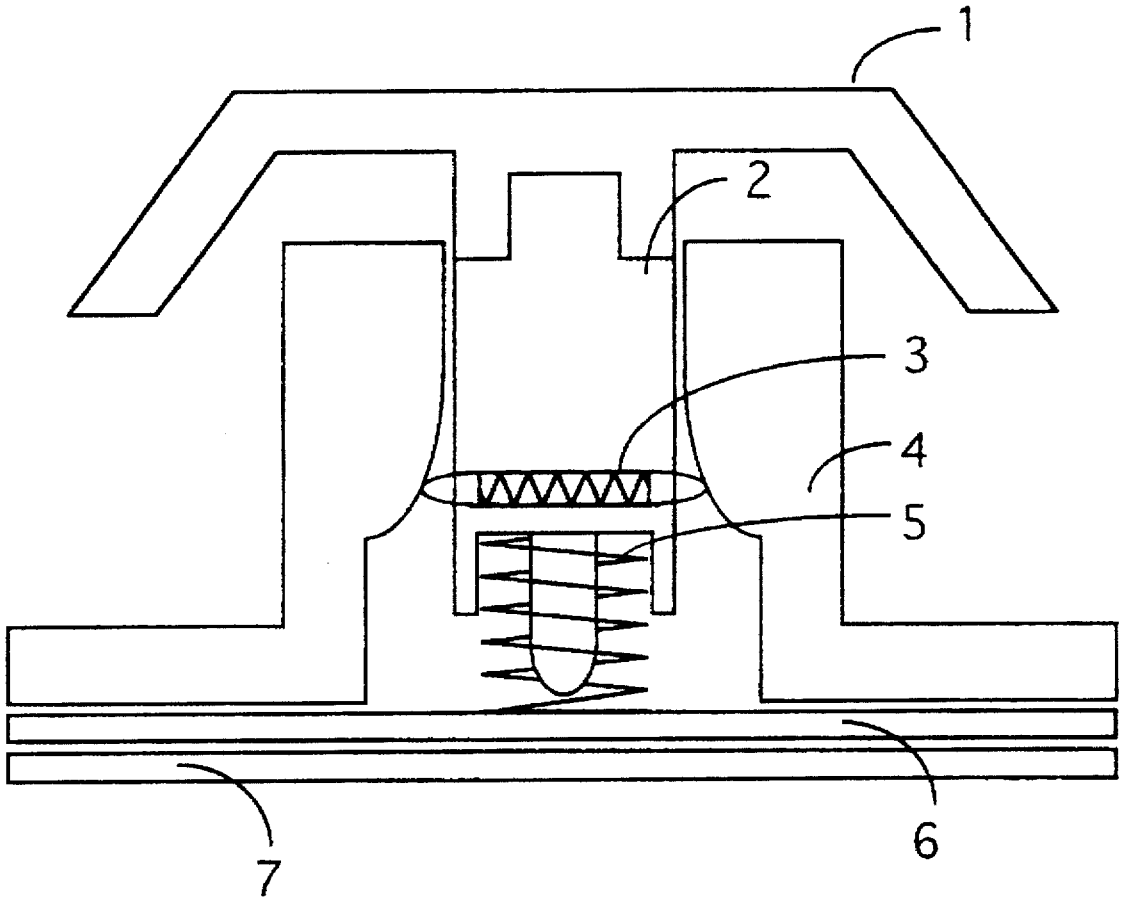
FIG. 2 is a sectional view showing the structure of the key switch according to the first embodiment of the present invention.

FIG. 2 shows the state of the key switch with the key top 1 pressed down. As shown in FIG. 2, when the key top 1 is pressed down, the second spring element 3 is also pressed downward and extends horizontally along the inclined internal wall of the housing 4. In this case, the second spring element 3 is in internal contact with the inclined internal wall. The horizontal force by which the second spring element 3 pushes the inclined internal wall generates the force which presses the key top 1, that is, the slider 2 downward.

The "downward press-down force" of the second spring element 3 is multiplied by the force which actually presses down the key top 1 to resist the rebound of the compressed first spring element 5. From another viewpoint, when the key top 1 is pressed down by a predetermined distance, the "downward press-down force" of the second spring element 3 is applied. Subsequently, the key top 1 is pressed down with a feeling of light touch.

If the second spring element 3 is not provided, the rebound of the first spring element 5 is increased as the key top 1 is pressed doom. Accordingly, the force which presses down the key top 1 (the rebound of the key top 1) should be increased so as to press down the key top 1 more. According to the present invention, the "downward press-down force" of the second spring element 3 is applied. Consequently, even though the key top 1 is pressed down more, the force of fingers which press down the key top 1 can be equal to the rebound of the key top 1 obtained when starting the press-down of the key top 1.

Figure 27A:
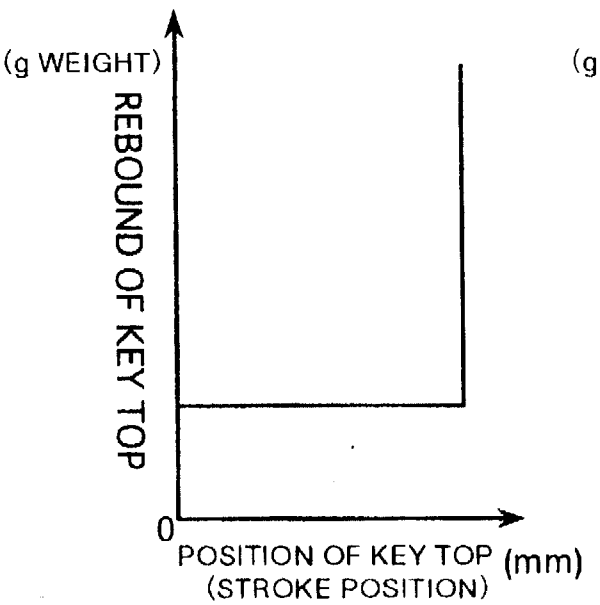
FIG. 27A is a chart showing an example of the ideal press-down characteristics (constant rebound: inclination= 0)

In this case, it is possible to obtain a key switch having the press-down characteristics shown in FIG. 27A. By adjusting the compressibility of the second spring element 3 in advance so as to be increased more, the rebound of the key top 1 can be made smaller than an initial value as the key top 1 is pressed down. In this case, it is possible to obtain a key switch having the press-down characteristics shown in FIG. 27B.

Figure 4A:
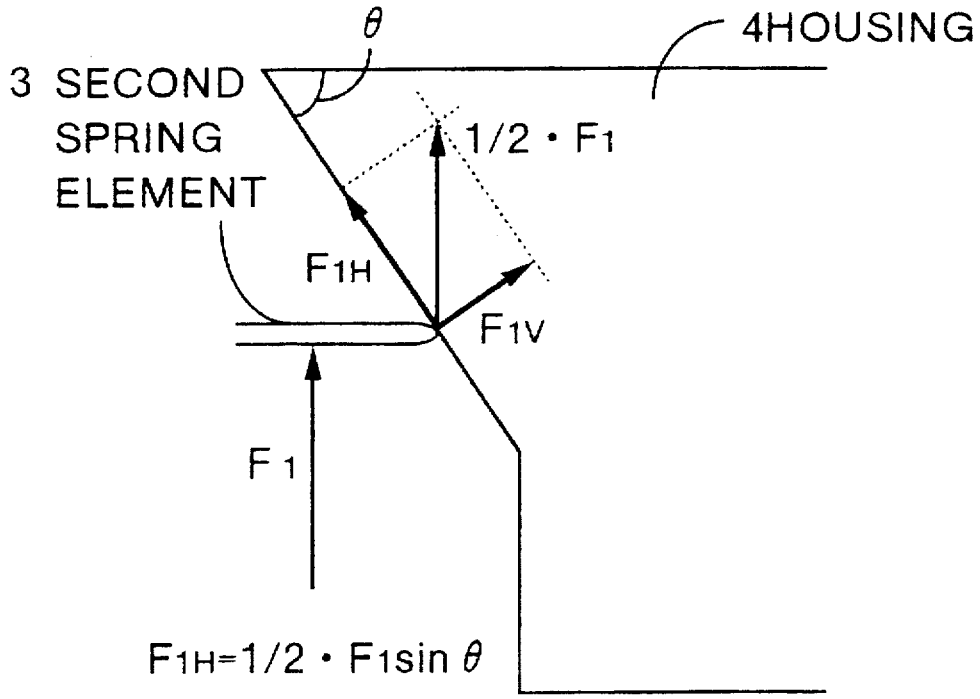
FIG. 4A is a diagram for explaining the action principle of the force of the spring element according to the present invention.
Figure 4B:
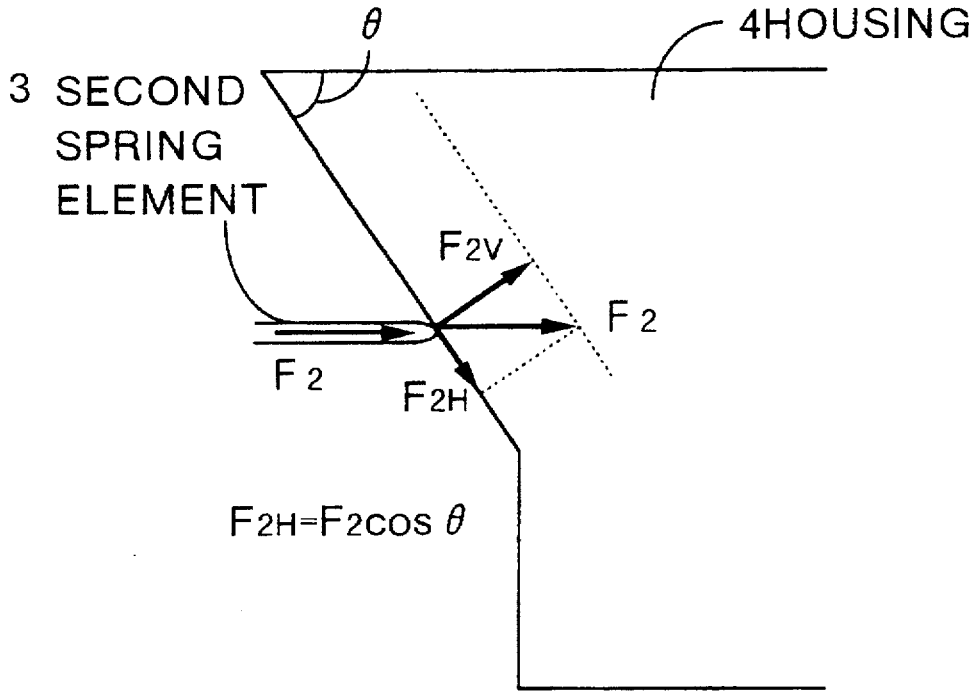
FIG. 4B is a diagram for explaining the action principle of the force of the spring element according to the present invention.

FIGS. 4A and 4B show the action principle of the force of first and second spring elements according to the present invention. FIG. 4A shows the operation of the force of the first spring element 5. FIG. 4B shows the operation of the force of the second spring element 3 which is inserted in the slider 2. It is assumed that the internal contact point of the second spring element 3 has no friction.

During balancing, the relationship ($F_{1H}=F_{2H}$) is expressed by the following equation:

$$F_1=2\cdot F_2/\tan\theta$$

wherein $F_1$ represents the rebound of the first spring element 5 and $F_2$ represents the force which the second spring element 3 pushes the internal wall. As indicated by the above-mentioned equation, the force $F_2$ of the second spring element 3 is increased or the angle θ is decreased so that the force $F_{2H}$ which resists the rebound can be increased. The second spring element 3 itself generates the force which is proportional to the amount of compression. The angle θ of the inclined face of the internal wall of the housing 4 can be set to an optional value. Consequently, the force can be freely varied with the angle θ for the stroke position of the key top 1. By changing the value of a coefficient of friction between the cap of the second spring element 3 and the housing 4, the rebound of the key top 1 can be varied.

If a key switch having the following characteristic values is fabricated, the press-down characteristics shown in FIG. 27A are obtained.

In the first embodiment shown in FIG. 1, when the key top 1 has a stroke length of 4 mm, the housing 4 has a height of 10 mm, the opening provided on the upper portion of the housing 4 has an inner diameter of 10 mm and the housing 4 has a shape of a1=0.00147, a2=0.0330 and a3=0.00619 wherein a1, a2 and a3 are curve coefficients expressed by Equation (9) which will be described below.

While the first spring element has a spring constant of 4 g/mm, the second spring element has a spring constant of 12 g/mm.

In this case, it is possible to fabricate a key switch having the press-down characteristics in which the rebound of the key top 1 is almost constant (FIG. 27A). If the housing 4 has a shape of a1=0.00726, a2=0.0306 and a3=0.0247, a key switch having the press-down characteristics shown in FIG. 27B can be fabricated.

The principle in which friction is caused between the internal wall of the housing 4 and the cap of the second spring element 3 will be described below.

Figure 5:
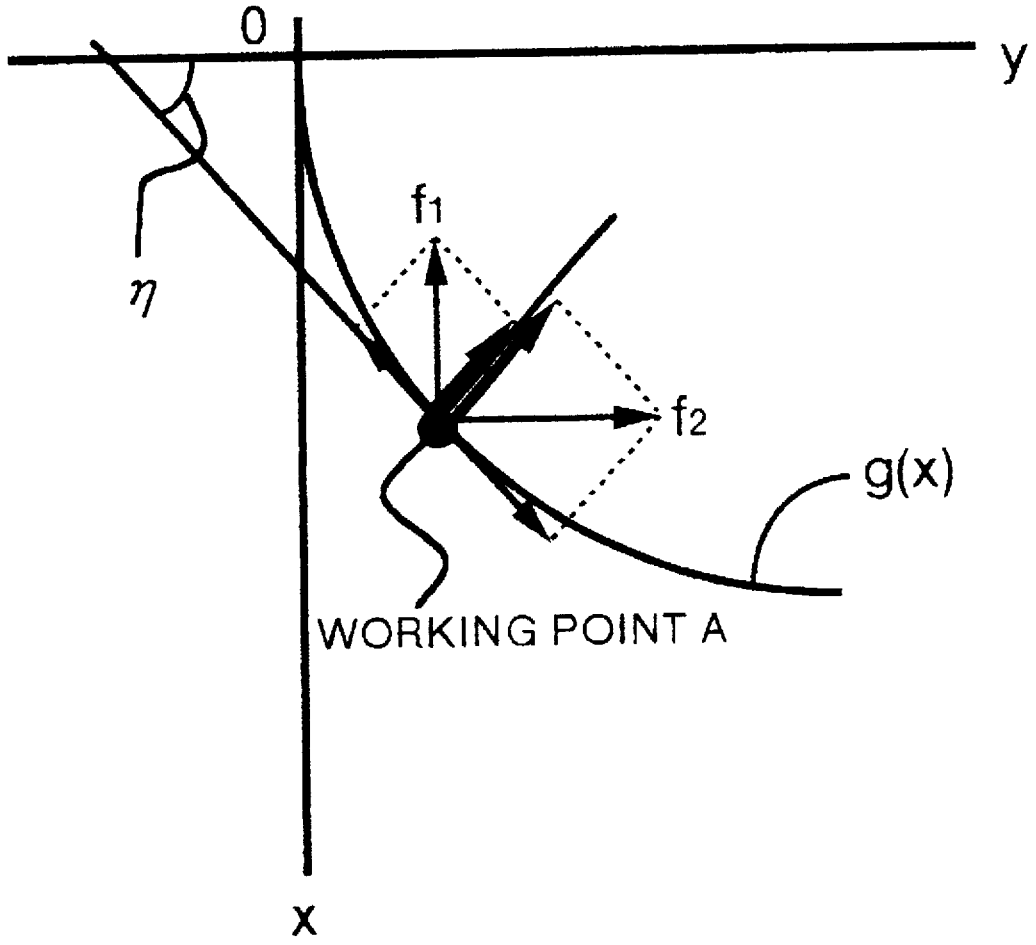
FIG. 5 is a diagram for explaining the action principle in consideration of the friction of the force of the spring element according to the present invention.

FIG. 5 shows the action principle of the force applied to the surface of the portion of the internal wall of the housing 4 with which the second spring element 3 comes in contact, wherein the shape of the surface is represented by g(x) and an internal contact working point is represented by A.

As shown in FIG. 5, rebounds f1 and f2 of the first and second spring elements 5 and 3 can be divided into a component in the direction of a slope tangent on the point A and a component in the direction perpendicular to the tangent. Rebounds f1 and f2 are expressed by the following equation by using the shrinkage of the spring:

$$f_1=\tfrac{1}{2}\cdot k1\cdot[l1-(x1+x)] \quad (1)$$

$$f_2=k2\cdot[l2-(x2+g(x))] \quad (2)$$

wherein l1 and l2 represent natural lengths of the first and second spring elements 5 and 3, and x1 and x2 represent precompressive lengths of the first and second spring elements 5 and 3.

g(x) designates a position on a y-axis on the tip of the second spring element 3 with the first spring element 5 shrinking by x from an origin of FIG. 5, which represents the shape of a slope.

The components in the direction parallel with and perpendicular to the inclined faces of the rebounds are obtained by the following equations.

$$f1H=f_1\cdot\cos(\eta)\ f2H=f_2\ \sin(\eta) \quad (3)$$

$$f1V=f_1\cdot\sin(\eta)\ f2V=f_2\ \cos(\eta) \quad (4)$$

The balance of the component in the direction parallel with the inclined face is expressed by the following equation, wherein a coefficient of dynamical friction on the inclined face is represented by μ.

$$F_H=f1H-[f2H+\mu\cdot(f1V+f2H)] \quad (5)$$

Equations (3) and (4) are substituted for Equation (5) to obtain the following equation.

$$F_H=(\cos(\eta))+\mu\cdot\sin(\eta))\cdot f_1-(\sin(\eta)-\mu\cdot\cos(\eta))\cdot f_2$$

Consequently, the rebound F of the key top 1 which actually acts on the fingers is as follows.

$$F=2\cdot\cos(\eta)\cdot[(\cos(\eta)+\mu\cdot\sin(\eta))\cdot f_1-(\sin(\eta)-\mu\cdot\cos(\eta))\cdot f_2]$$

If the right side is tied up with cos(η), the following equation is obtained:

$$F=2\cdot\cos(\eta)^2[(1+\mu\cdot\tan(\eta))\cdot f_1-(\tan(\eta)-\mu)\cdot f_2]$$

$\cos(\theta)^2=1/(1+\tan(\theta)^2)$ is substituted for the abovementioned equation:

$$F=2\cdot(1/(1+\tan(\eta)^2))\cdot[(1+\mu\cdot\tan(\eta))\cdot f_1-(\tan(\eta)-\mu)\cdot f_2] \quad (6)$$

wherein tan(η) is an inclination of a tangent of a slope shape function g(x) on the working point A.

$$\tan(\eta)=(d/dx)\ g(x) \quad (7)$$

Equations (1), (2) and (7) are substituted for Equation (6) to obtain Equation (8).

$$F=2\cdot\frac{1}{1+\left(\frac{d}{dx}g(x)\right)^2}\cdot\left[\begin{array}{l}\left(1+\mu\frac{d}{dx}g(x)\right)\cdot\frac{1}{2}\cdot k1\cdot[l1-(x1+x)]\ldots+\\ \left(\mu-\frac{d}{dx}g(x)\right)\cdot k2\cdot[l2-(x2+g(x))]\end{array}\right]$$

g(x) obtained by Equation (8) represents the slope shape. For example, 50 (g) is substituted for F of Equation (8) to obtain the function g(x) in order to realize the press-down characteristics shown in FIG. 19.

A differential equation (6) is analytically hard. Consequently, the function g(x) is usually obtained approximately by a numerical analysis method.

A specific example of the case where the cap material of the second spring element 3 is polyacetal (equivalent to LA531 manufactured by Asahi Chemical Industries Co., Ltd.) will be described below.

Coefficient of friction μ: 0.15

Spring constant of the first spring element 5 k1: 4 (g/mm)

Spring constant of the second spring element 3 k2: 12 (g/mm)

Natural length of the first spring element 5 l1: 20 (mm)

Natural length of the second spring element 3 l2: 10 (mm)

Precompressive length of the first spring element 5 x1: 10 (mm)

Precompressive length of the second spring element 3 x2: 3 (mm)

Total stroke length of the key top 1: 4.0 (mm)

If the constants which are defined as described above are substituted for Equation (8), the slope shape g(x) of the housing 4 is approximately expressed by Equation (9):

$$g(x)=a1\cdot x^3+a2\cdot x^2+a3\cdot x \quad (9)$$

wherein a1=0.00147, a2=0.00330 and a3=0.00619.

Figure 20:
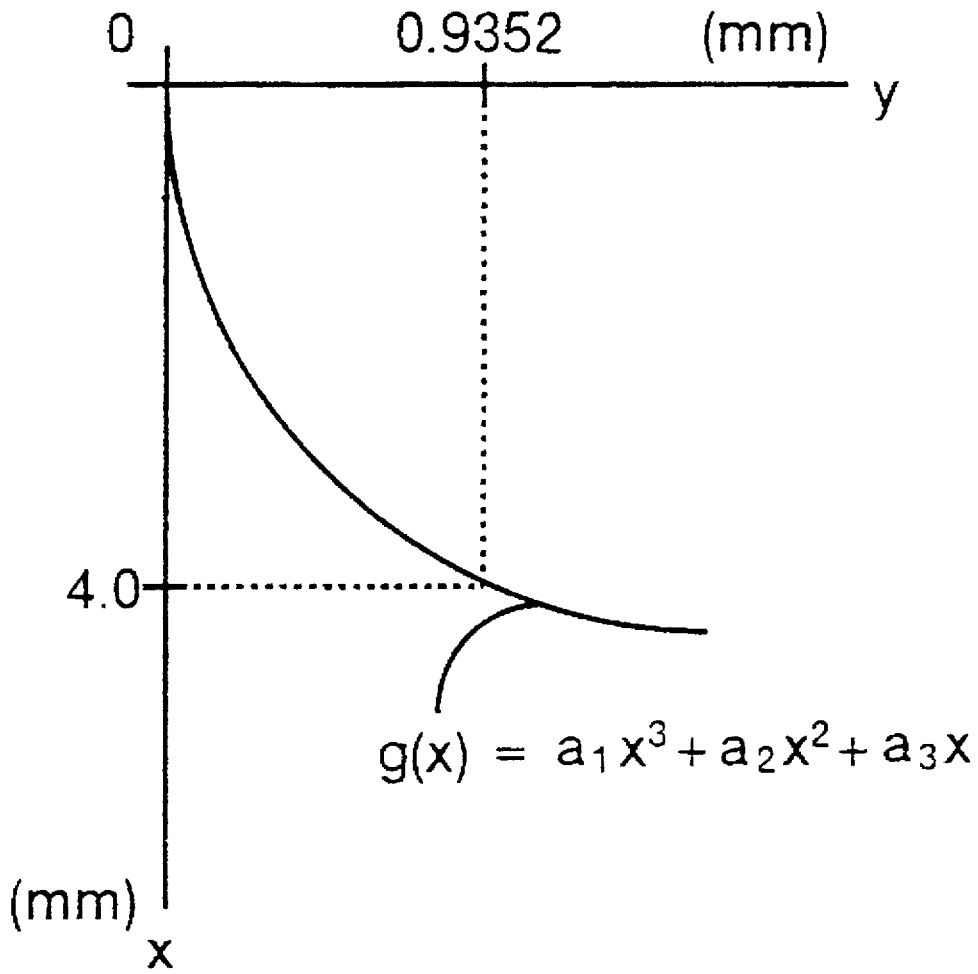
FIG. 20 is a chart showing a specific example of the surface shape of the internal wall of the housing used in the present invention.

FIG. 20 shows g(x), that is, an example of the surface shape of the internal wall of the housing 4.

Figure 19:
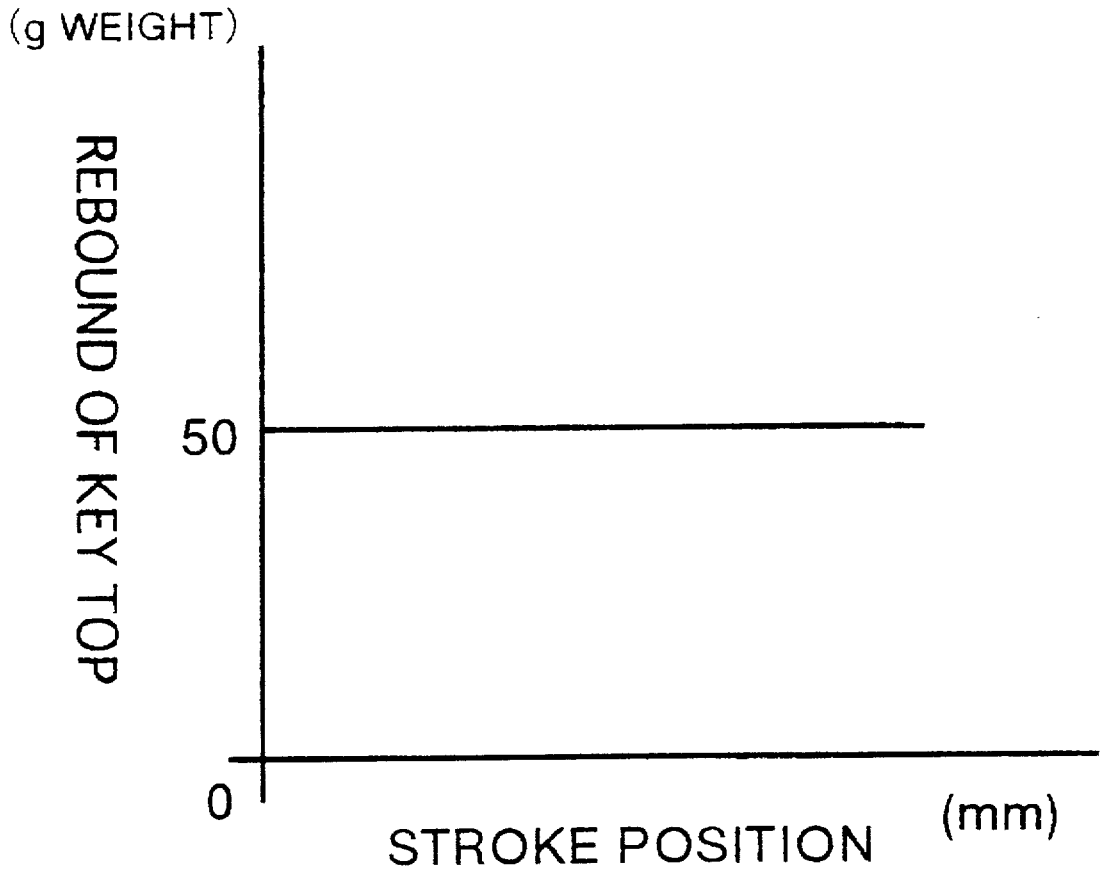
FIG. 19 is a chart showing one of the press-down characteristics to be realized by the present invention.

If the housing 4 having the internal wall represented by g(x) is formed, an ideal key switch having the press-down characteristics shown in FIG. 19, that is, FIG. 27A can be fabricated.

While the internal wall portions 4A and 4C are parallel with the press-down direction in the opening of the housing 4 and the internal wall portion 4B has a curved inclination in the first embodiment shown in FIG. 1, the internal wall portions 4A and 4C may have the inclinations.

In this case, it is possible to get the press-down characteristics having a sense of click shown in FIG. 27 C.

Figure 21:
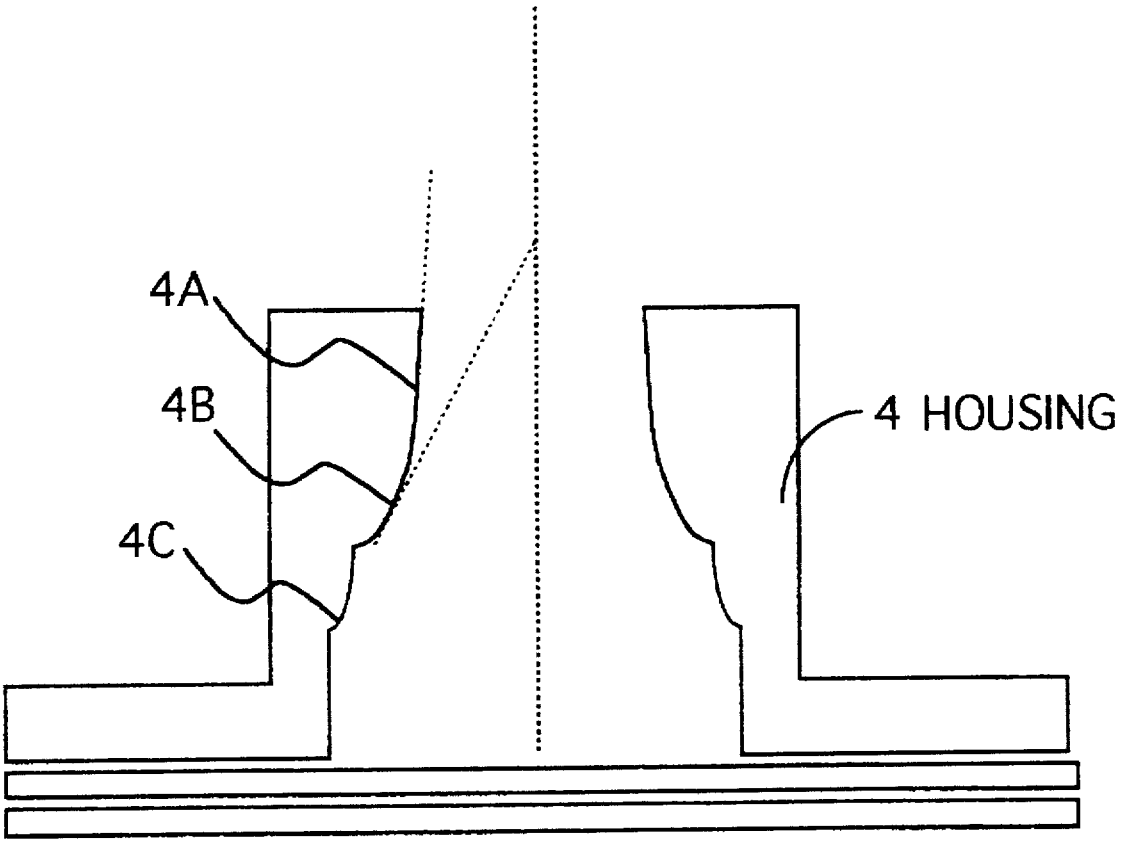
FIG. 21 is a diagram showing a variant of the shape of the housing according to the first embodiment of the present invention.

FIG. 21 is a schematic view showing a housing in which the internal wall portions 4A and 4C have the inclinations in the first embodiment.

Figure 22:
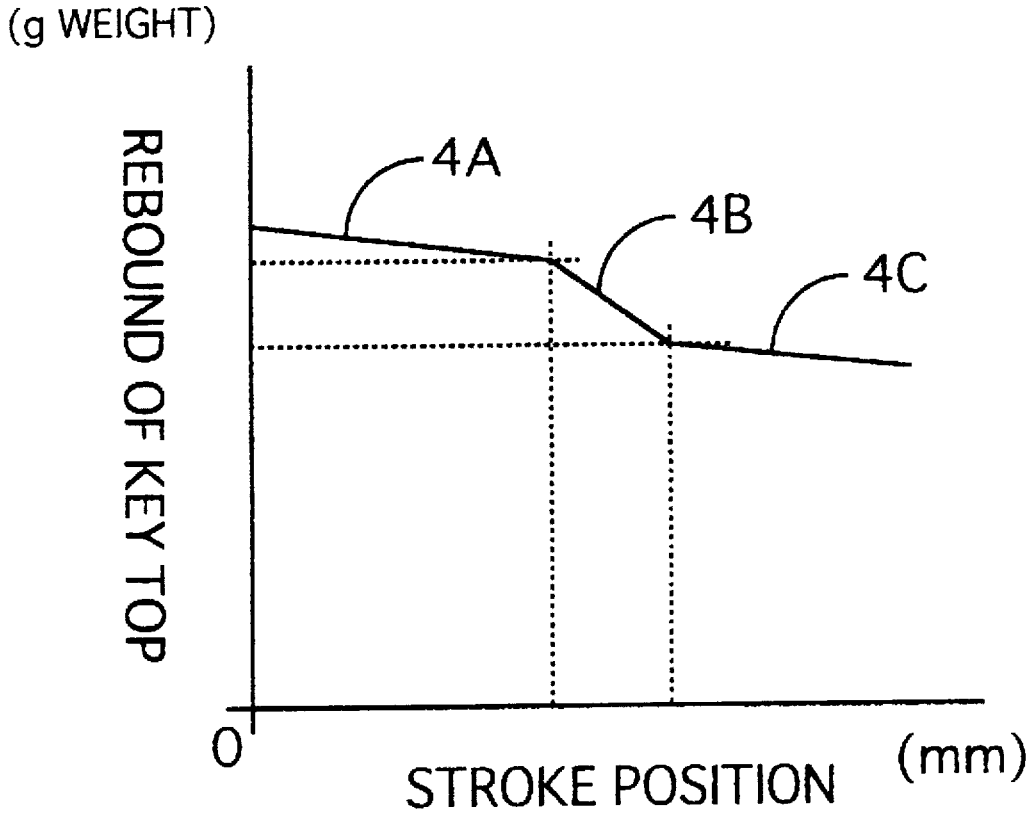
FIG. 22 is a chart showing the press-down characteristics in FIG. 21.

FIG. 22 shows the press-down characteristics obtained by employing the housing 4 shown in FIG. 21.

As shown in FIG. 22, the rebound of the key top 1 is decreased a little smoothly when the second spring element 3 slides on the inclined face 4A. However, the rebound of the key top 1 is rapidly decreased when the key top 1 is pressed down to the position of the inclined face 4B.

In other words, the striking change of the rebound gives a sense of click to a feeling of touch of the key top 1.

SECOND EMBODIMENT

Figure 6:
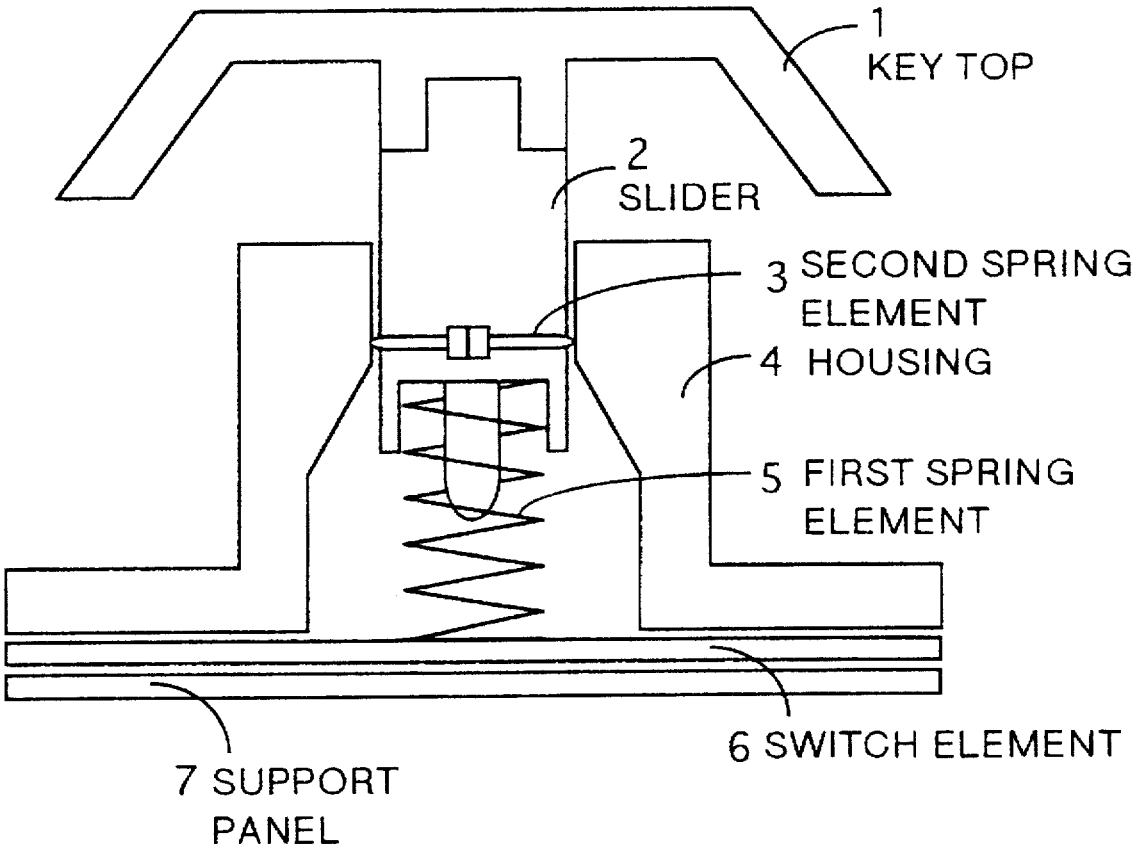
FIG. 6 is a sectional view showing the structure of a key switch according to a second embodiment of the present invention.
Figure 7:
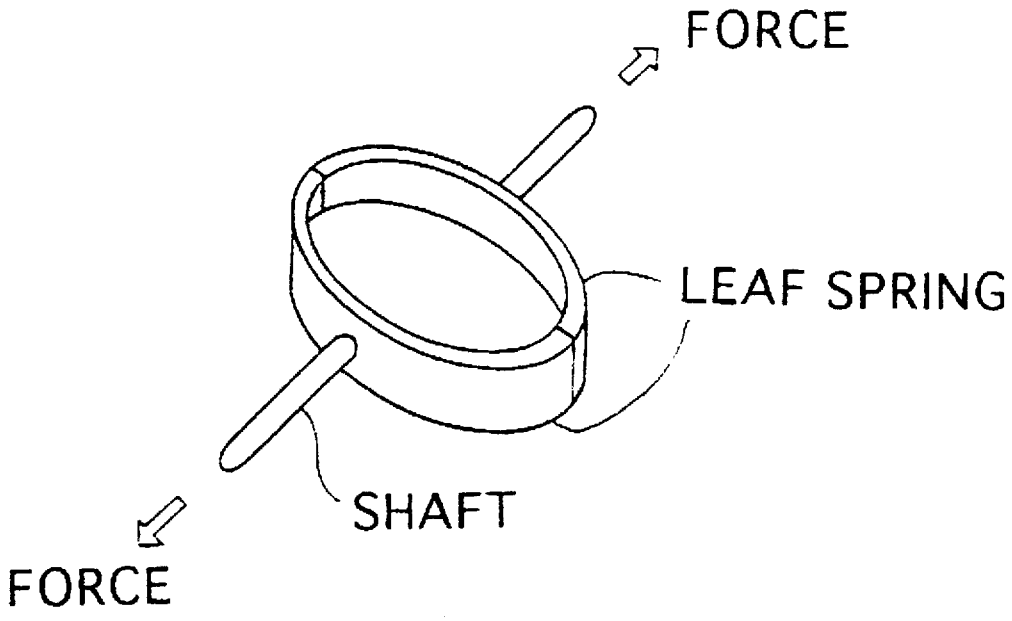
FIG. 7 is a view showing an example of the structure of a second spring element 3 according to the second embodiment of the present invention.

FIGS. 6 and 7 show the structure of a key switch according to a second embodiment of the present invention. FIG. 6 shows a structure in which the second spring element 3 according to the first embodiment has a shaft attached to a leaf spring that causes buckling shown in FIG. 7. With such a structure, the rebound of the second spring element 3 is varied with a stroke. Consequently, the press-down characteristics having the sense of click shown in FIG. 27C can be obtained without making the shape of the housing complicated.

THIRD EMBODIMENT

Figure 8:
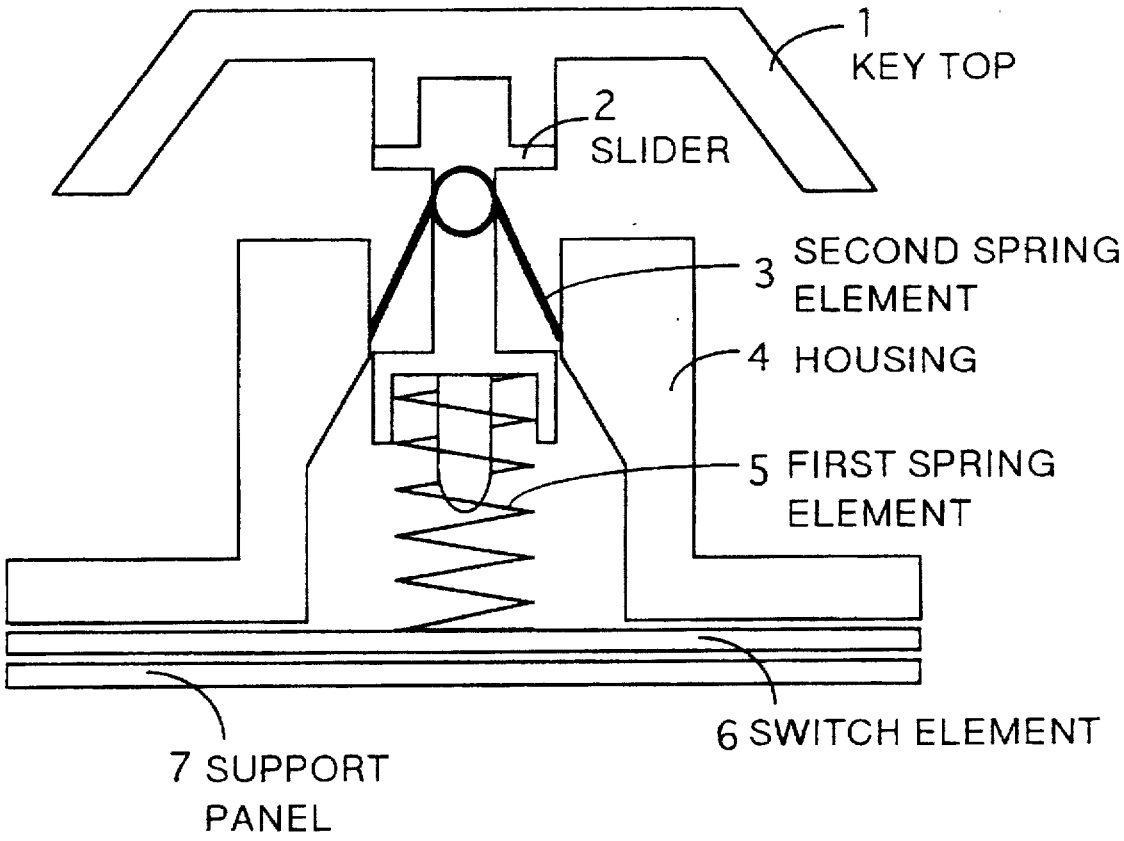
FIG. 8 is a sectional view showing the structure of a key switch according to a third embodiment of the present invention.
Figure 9:
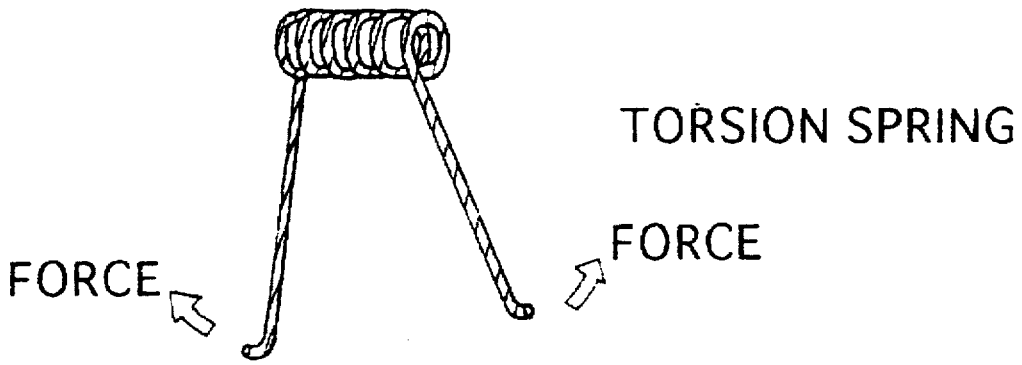
FIG. 9 is a view showing an example of the structure of a second spring element 3 according to the third embodiment of the present invention.

FIGS. 8 and 9 show the structure of a key switch according to a third embodiment of the present invention.

FIG. 8 shows a structure in which the second spring element 3 according to the first embodiment is a torsion spring shown in FIG. 9.

In the case where the spring element shown in FIG. 3 is used, it is necessary to increase the width of the slider to some extent in order to increase the variable width of the press-down characteristics. For example, the slider 2 should have a diameter of 10 mm or more in order to set the transverse elongation of the spring element to about 5 mm. Consequently, the total width of the key switch is 20 mm or more. As a result, it is impossible to realize that the key switch of a standard keyboard has a width of 19 mm.

By using the torsion spring shown in FIG. 9, the transverse elongation can be increased irrespective of the diameter of the slider 2. Consequently, the slider 2 can be made thinner. For example, the diameter of the slider 2 can be set to about 5 mm. In this case, the key switch have a width of about 15 mm. Accordingly, such a key switch can also be used for the standard keyboard. Thus, the width of the key switch can be reduced by using the torsion spring.

Also in the present embodiment, the inclined face of the internal wall of the housing 4 is formed so as to match with the motion of arm parts of the torsion spring in the same principles as in the first embodiment, so that the same press-down characteristics can be obtained.

FOURTH EMBODIMENT

Figure 10:
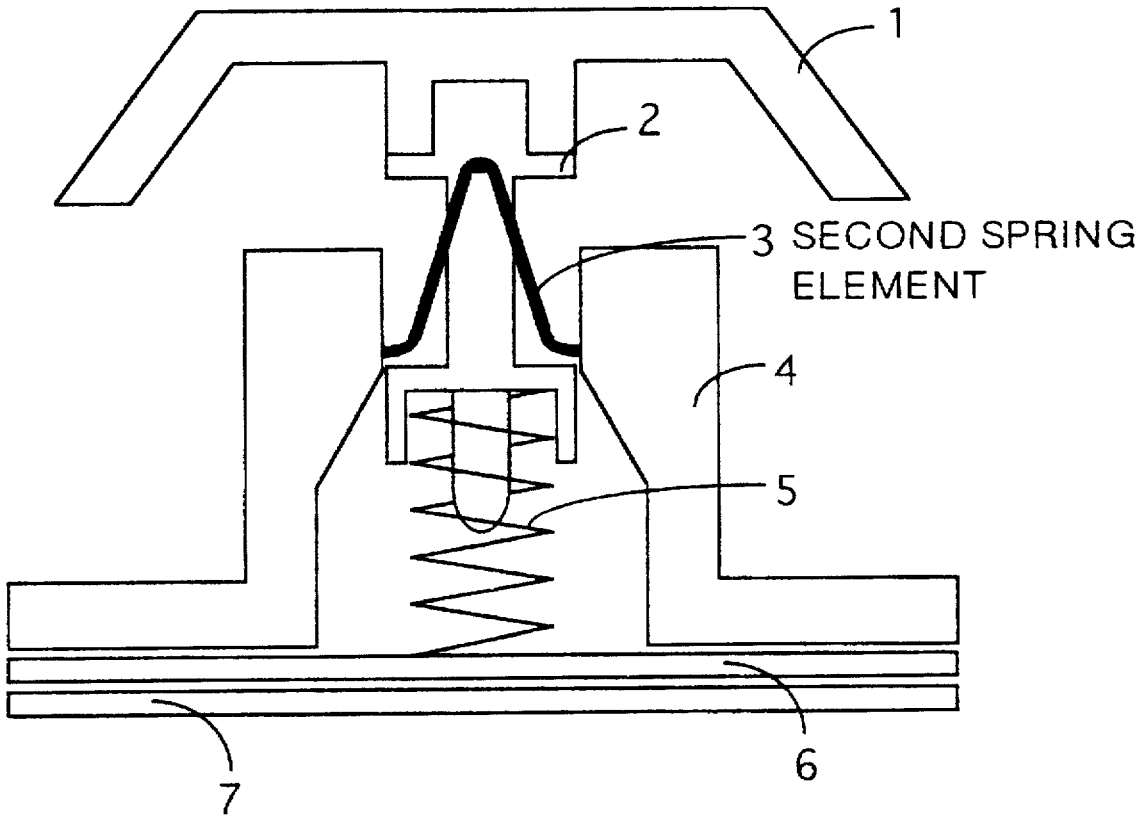
FIG. 10 is a sectional view showing the structure of a key switch according to a fourth embodiment of the present invention.
Figure 11:
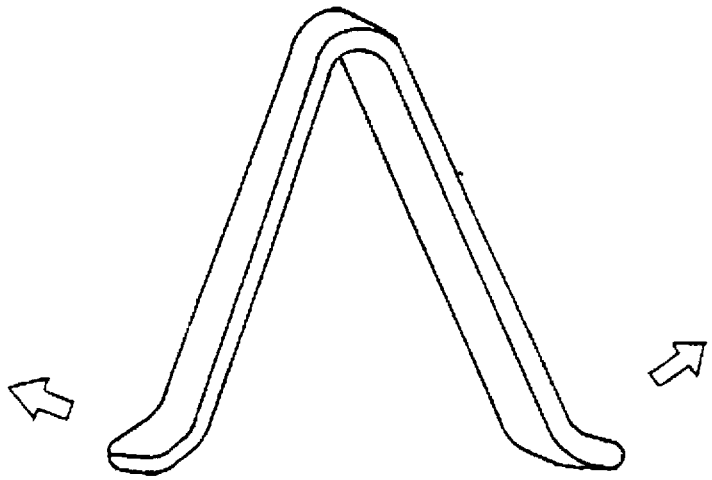
FIG. 11 is a view showing an example of the structure of a second spring element 3 according to the fourth embodiment of the present invention.

FIGS. 10 and 11 show the structure of a key switch according to a fourth embodiment of the present invention.

FIG. 10 has a structure in which a leaf spring made of a resin material shown in FIG. 11 is used for the spring element according to the first embodiment. For example, a polyacetal resin can be used as in the slider 2. In this case, the spring element can be molded integrally with the slider 2. Consequently, the number of parts and man-day can be reduced more than in the abovementioned embodiments.

FIFTH EMBODIMENT

Figure 12:
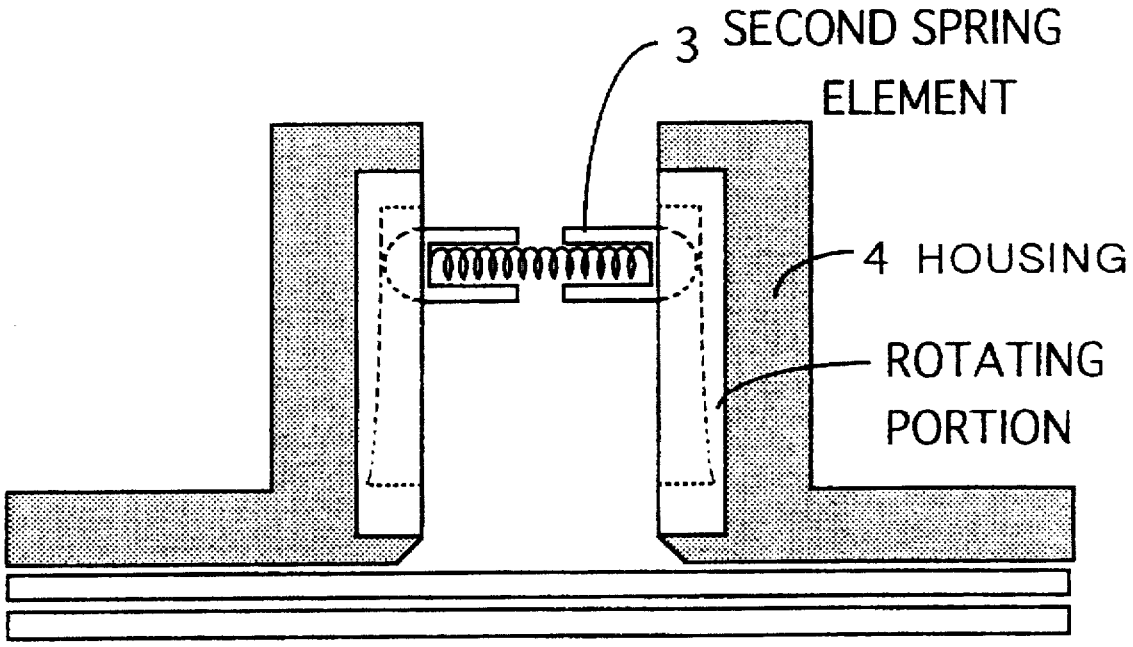
FIG. 12 is a sectional view showing the structure of a housing of a key switch according to a fifth embodiment of the present invention.
Figure 13A:
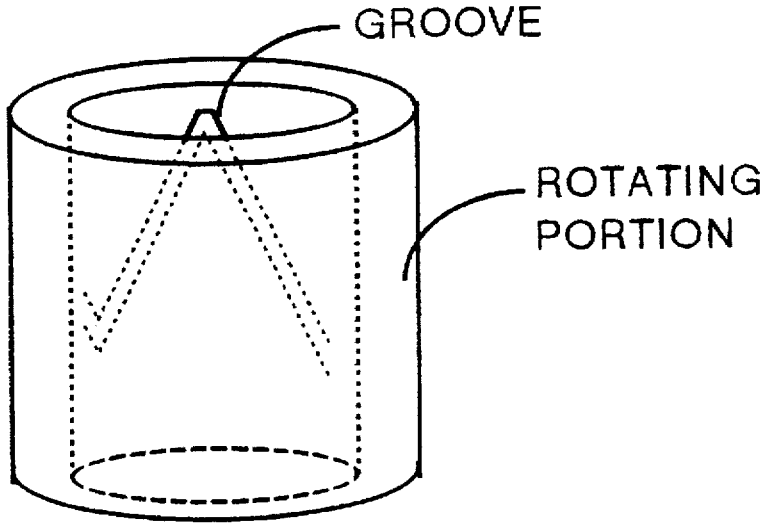
FIG. 13A is a perspective view showing the structure of a rotating portion of the housing according to the fifth embodiment of the present invention.
Figure 13B:
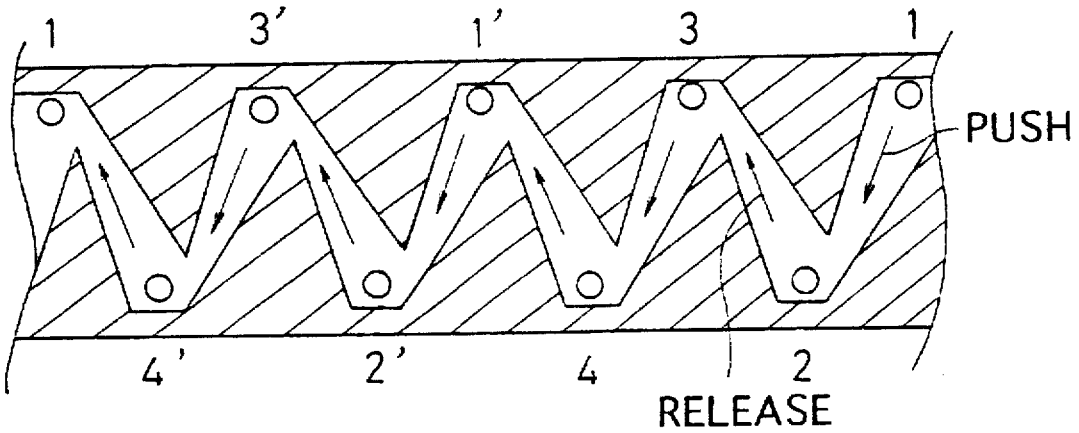
FIG. 13B is a developed view showing the structure of the rotating portion of the housing according to the fifth embodiment of the present invention.

FIGS. 12, 13A and 13B show a second spring element 3 and a housing portion of a key switch according to a fifth embodiment of the present invention.

As shown in FIG. 12, a housing 4 comprises the same key fixing portion as in the above-mentioned embodiments and a rotating portion which horizontally rotates around the press-down directional axis. A groove is formed on the internal wall of the rotating portion to surround the internal wall of the rotating portion like a zigzag. Both ends of the second spring element 3 are fitted in the groove.

FIG. 13A is a perspective view showing the internal face of the rotating portion. FIG. 13B is a developed view showing the internal face of the rotating portion. For example, in the case where the ends of the second spring element 3 are placed on points 1 and 1', the ends of the second spring element 3 move toward points 2 and 2' when the key top 1 is pressed down. When the key top 1 is released, the ends of the second spring element 3 move toward points 3 and 3'. When the key top 1 is further pressed down, the ends of the second spring element 3 move toward points 4 and 4'. When the key top 1 is then released, the ends of the second spring element 3 move toward the points 1 and 1'. In other words, every time the key top 1 is pressed down, the second spring element 3 repeats the above-mentioned operation.

Since the second spring element 3 is attached to the slider 2, it moves vertically. A part of the housing 4 can rotate so that the ends of the second spring element 3 move in the groove of the rotating portion. Consequently, it is possible to distinguish a path which passes through the housing 4 when the key top 1 is pressed down from a path which passes through the housing 4 when the key top 1 is released.

If the paths which pass through the housing 4 during the press-down and release of the key top 1 have different inclinations, the press-down characteristics can be changed during the press-down and release of the key top 1. By changing the press-down characteristics, thus, it is possible to obtain a feeling of touch in which a sense of click can be given when pressing down the key top 1 and no sense of click is obtained when releasing the key top 1.

Figure 23A:
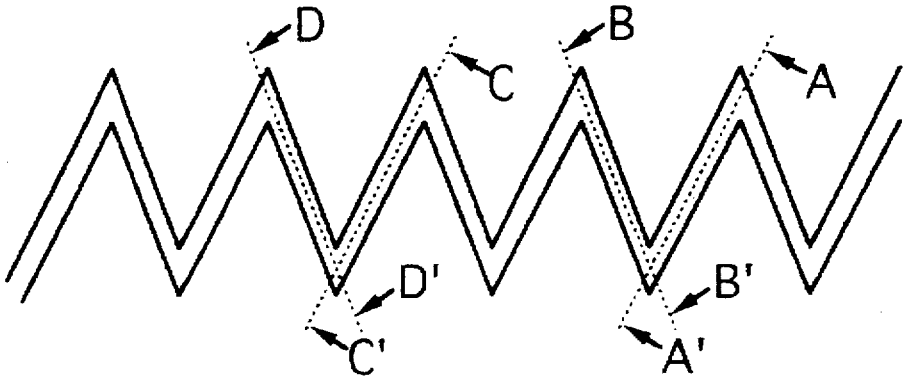
FIG. 23A is a diagram showing a specific example of the shape of a groove of the rotating portion of the housing according to the fifth embodiment of the present invention.
Figure 23B:
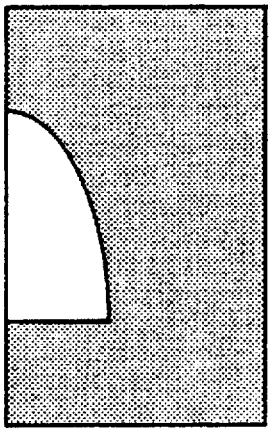
FIG. 23B is a diagram showing a specific example of the sectional shape of grooves A–A' and C–C' of the rotating portion of the housing according to the fifth embodiment of the present invention.
Figure 23C:
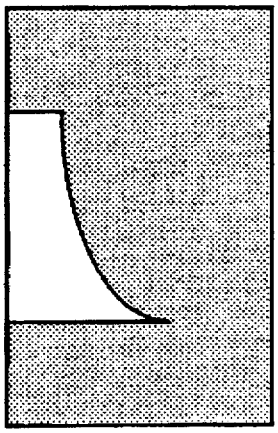
FIG. 23C is a diagram showing a specific example of the sectional shape of grooves B—B' and D—D' of the rotating portion of the housing according to the fifth embodiment of the present invention.

FIGS. 23A, 23B and 23C show specific examples of the shape of the groove formed on the rotating portion of the housing 4 according to the fifth embodiment. FIG. 23A is a developed view showing the groove in the same manner as in FIG. 13A. FIGS. 23B and 23C are sectional views showing the shape of the groove for FIG. 23A.

More specifically, FIG. 23B shows the shape of the groove along axes A—A' and C—C' in FIG. 23A. FIG. 23C shows the shape of the groove along axes B—B' and D—D' in FIG. 23A.

Figure 24:
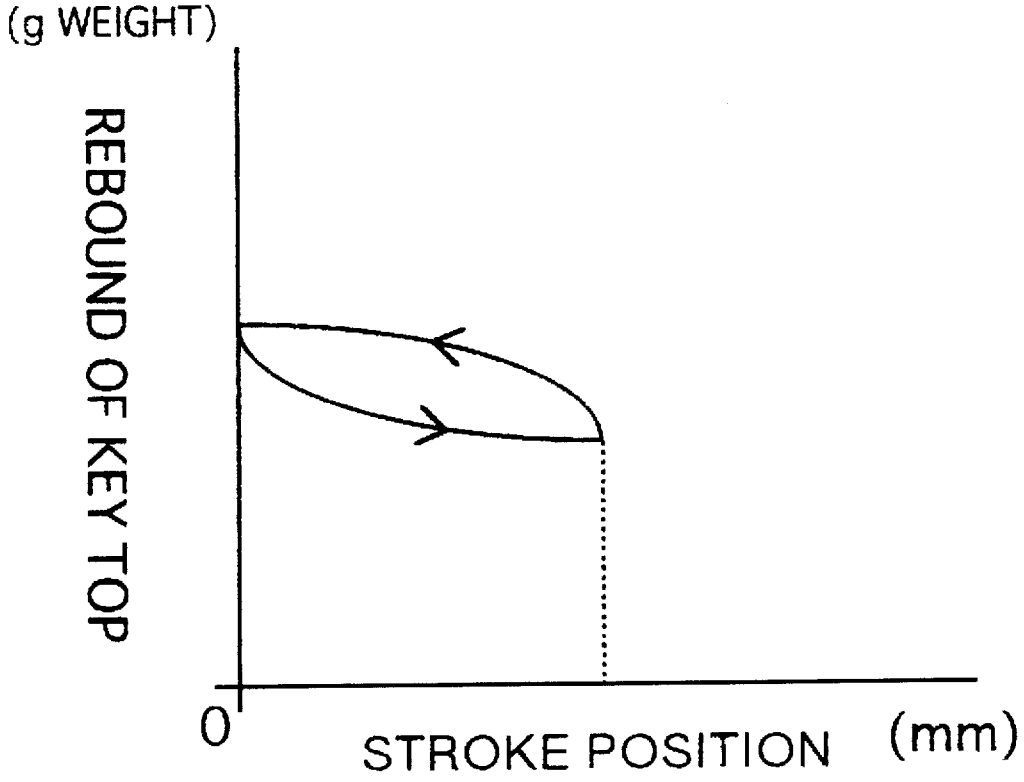
FIG. 24 is a chart showing the press-down characteristics in FIG. 23.
Figure 25:
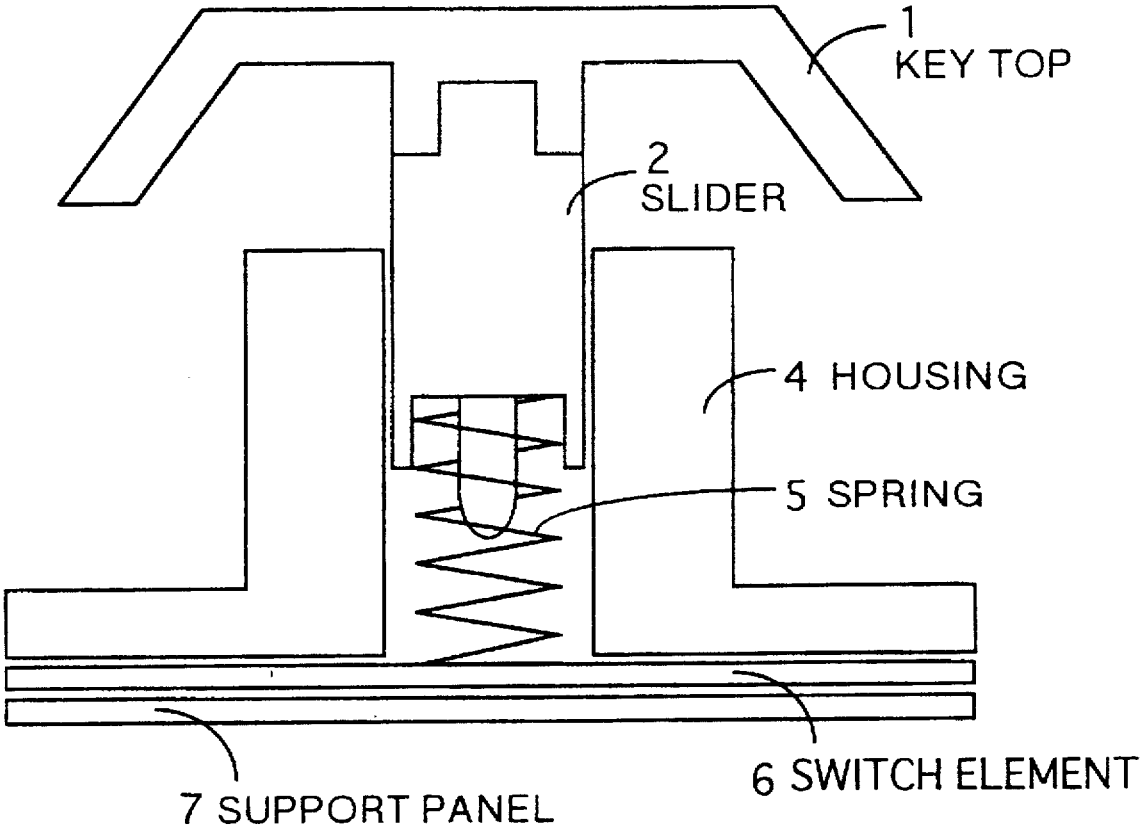
FIG. 25 PRIOR ART
FIG. 25 is a sectional view showing the structure of a key switch according to the prior art.
Figure 26C:
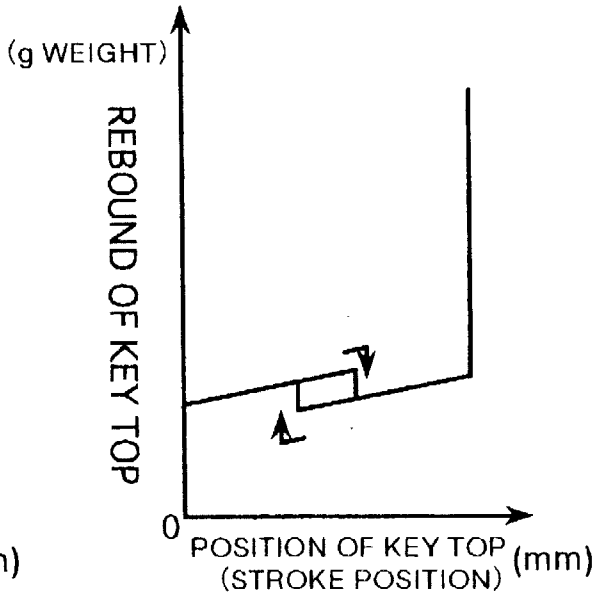
FIG. 26C PRIOR ART
FIG. 26C is a chart showing the press-down characteristics of the key switch according to the prior art (wherein the spring and the rubber cup are used)
Figure 26B:
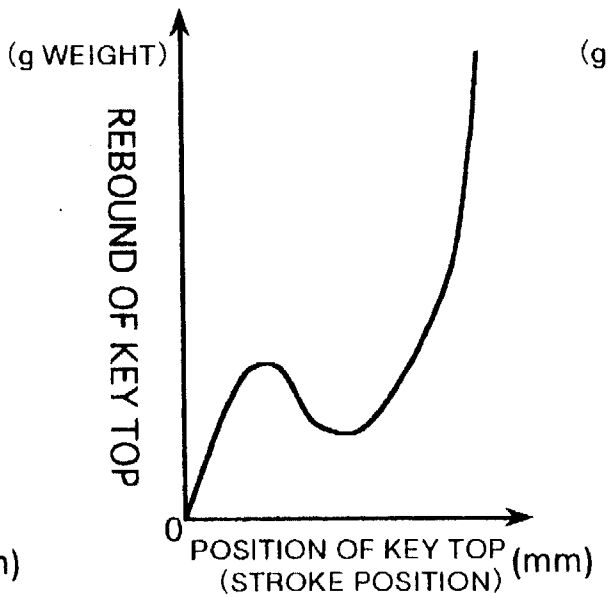
FIG. 26B PRIOR ART
FIG. 26B is a chart showing the press-down characteristics of the key switch according to the prior art (wherein a rubber cup is used)
Figure 26A:
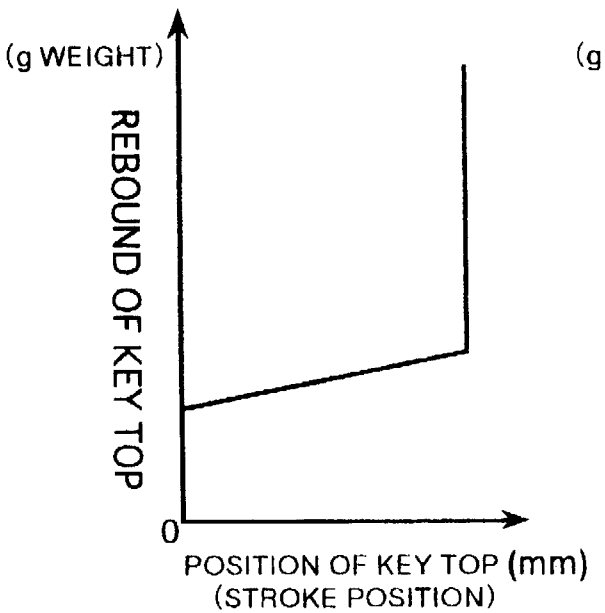
FIG. 26A PRIOR ART
FIG. 26A is a chart showing the press-down characteristics of the key switch according to the prior art (wherein a spring is used)

By forming the groove having the above-mentioned shape, it is possible to realize the press-down characteristics having a sense of click which is varied when pressing down and releasing the key top 1 as shown in FIG. 24.

SIXTH EMBODIMENT

Figure 14:
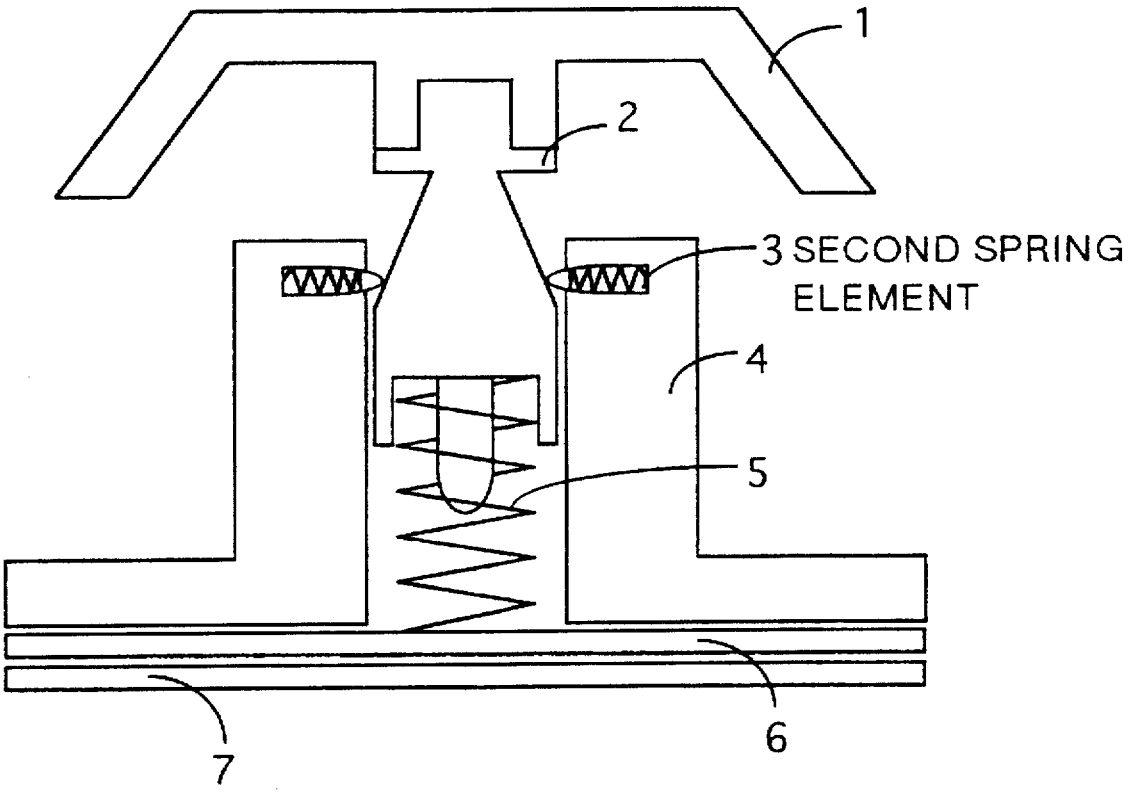
FIG. 14 is a sectional view showing the structure of a key switch according to a sixth embodiment of the present invention.

FIG. 14 shows the structure of a key switch according to a sixth embodiment of the present invention.

As shown in FIG. 14, a part of a slider 2 has an inclination and a second spring element 3 is incorporated in a housing 4.

Only a portion of the slider 2 with which the second spring element 3 comes in contact may be an inclined groove. Also in the present embodiment, vertical force can be generated against the rebound of a first spring element 5 with the relationship between the horizontal force of the second spring element 3 and the angle of the inclined face of the slider 2 by the same principle as in the first embodiment shown in FIG. 4.

Figure 27B:
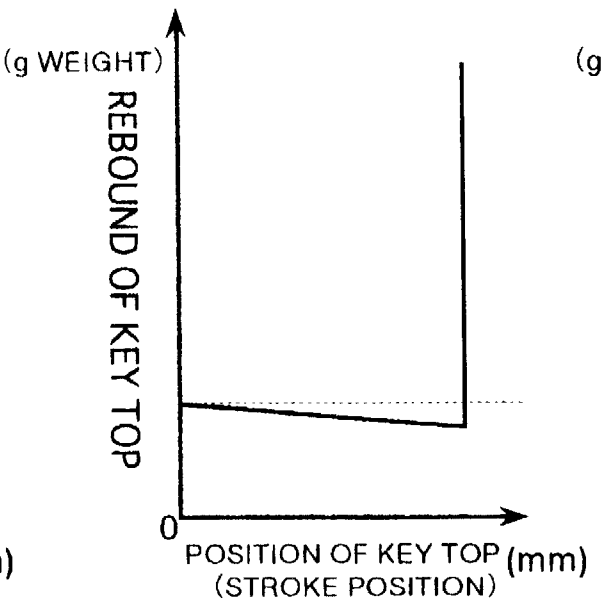
FIG. 27B is a chart showing an example of the ideal press-down characteristics (decreased rebound: negative inclination)

By setting the angle of the inclined face of the slider 2 to a predetermined value, it is possible to form a key switch having the press-down characteristics shown in FIG. 27A or 27B. The second spring element 3 can be made of the same material as in the first embodiment.

SEVENTH EMBODIMENT

Figure 15:
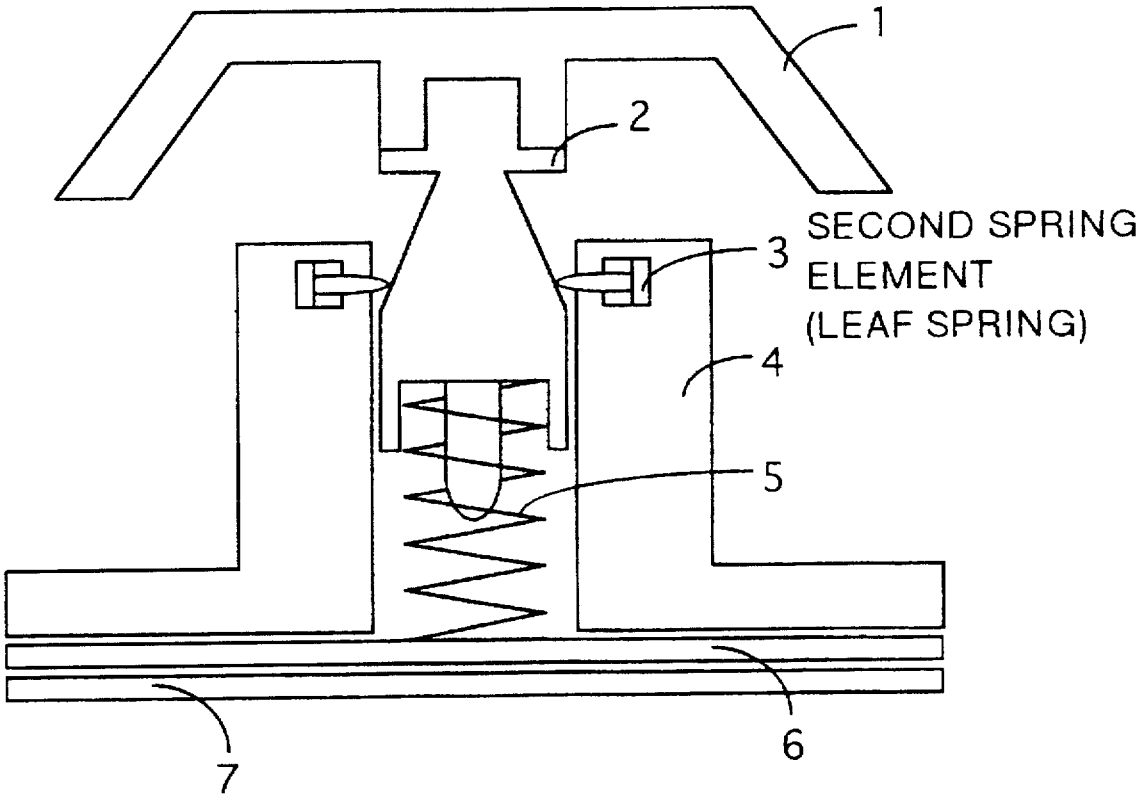
FIG. 15 is a sectional view showing the structure of a key switch according to a seventh embodiment of the present invention.

FIG. 15 shows the structure of a key switch according to a seventh embodiment of the present invention.

FIG. 15 shows a structure in which the second spring element 3 according to the sixth embodiment is formed by a leaf spring that causes buckling shown in FIG. 7. Also in this case, it is possible to obtain the press-down characteristics having the same sense of click as in the second embodiment.

EIGHTH EMBODIMENT

Figure 16:
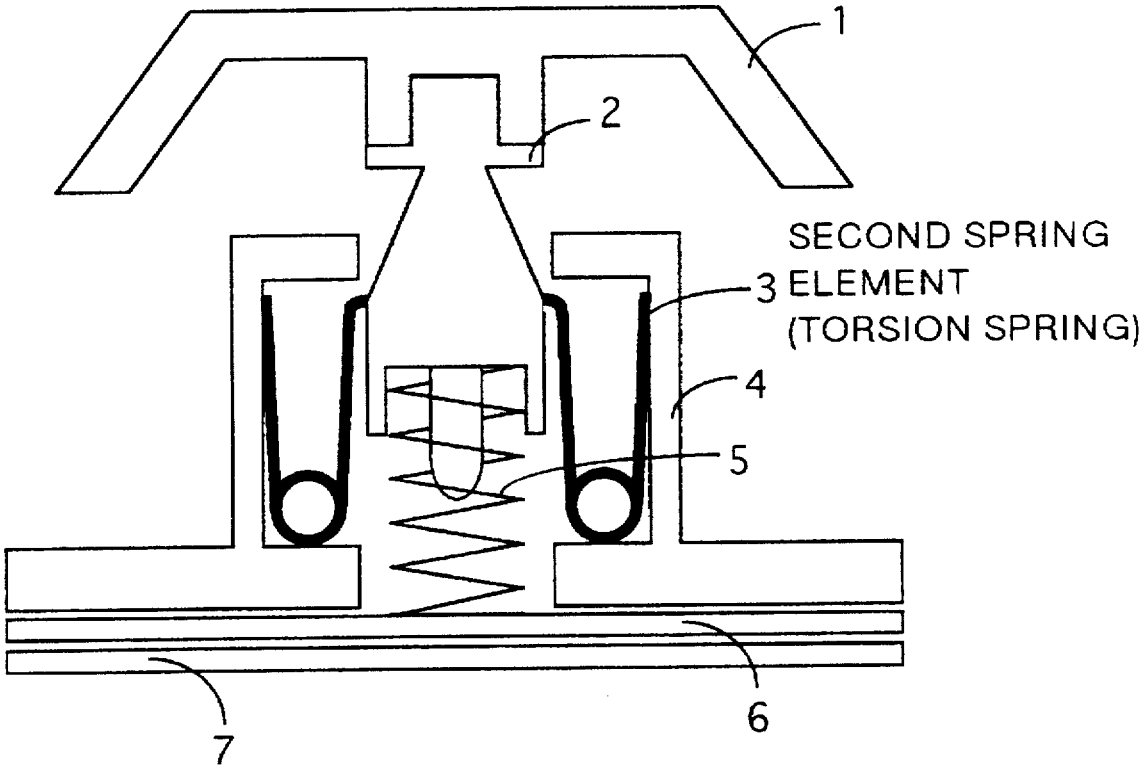
FIG. 16 is a sectional view showing the structure of a key switch according to an eighth embodiment of the present invention.

FIG. 16 shows the structure of a key switch according to an eighth embodiment of the present invention.

FIG. 16 shows a structure in which the second spring element 3 according to the sixth embodiment is formed by a torsion spring shown in FIG. 9. According to the present embodiment, it is possible to form a key switch having a small width in the same manner as in the third embodiment.

NINTH EMBODIMENT

Figure 17:
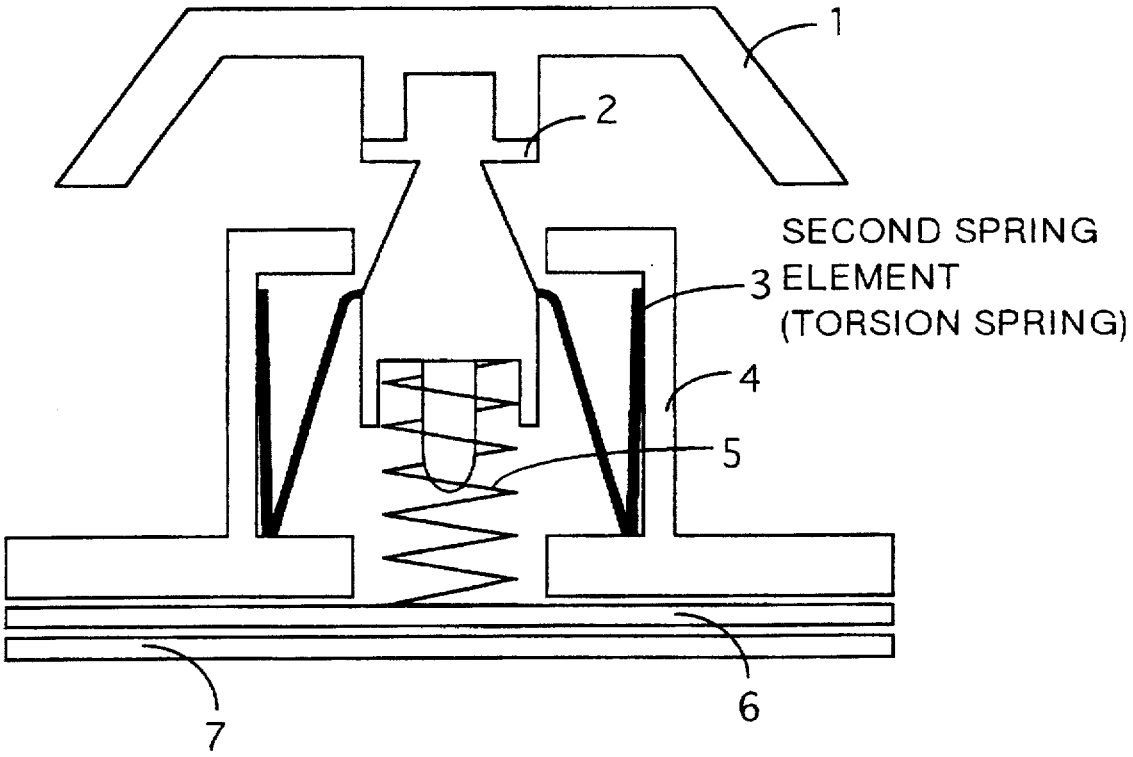
FIG. 17 is a sectional view showing the structure of a key switch according to a ninth embodiment of the present invention.

FIG. 17 shows the structure of a key switch according to a ninth embodiment of the present invention.

The key switch shown in FIG. 17 has a structure in which a leaf spring made of a resin material shown in FIG. 11 is inserted as a second spring element 3 in the concave portion of the opening of the housing 4. If the a polyacetal resin is used for the leaf spring as in the housing 4, the leaf spring can be molded integrally with the housing 4. Consequently, the number of parts and manufacturing man-day can be reduced.

TENTH EMBODIMENT

Figure 18:
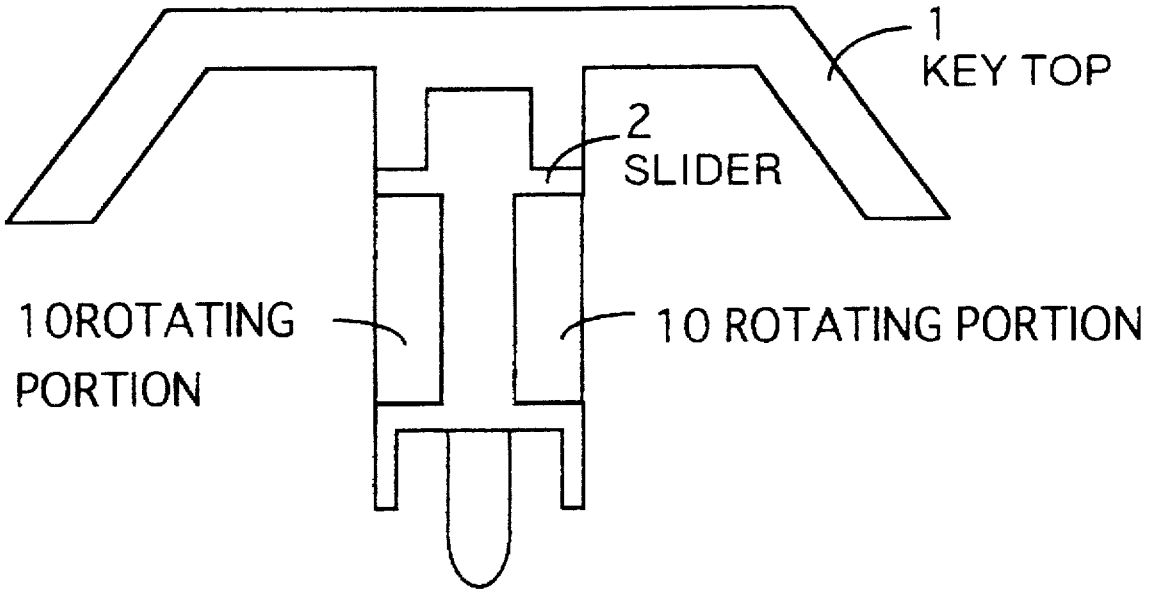
FIG. 18 is a sectional view showing the structure of a slider of a key switch according to a tenth embodiment of the present invention.

FIG. 18 shows a key top 1 and a slider 2 of a key switch according to a tenth embodiment of the present invention. Other portions are the same as in the sixth embodiment shown in FIG. 14, for example.

In FIG. 18, a part of the slider 2 is provided with a rotating portion 10. In order to rotate horizontally around the press-down directional axis, the rotating portion 10 is attached to the peripheral portion of the slider 2 with which a second spring element 3 comes in contact.

In the same manner as in the fifth embodiment, the periphery of the rotating portion 10 is provided with the groove shown in FIG. 23A. Both ends of the second spring element 3 are inserted in the groove. Also in this case, it is possible to obtain a feeling of touch having a sense of click which is varied when pressing down and releasing the key top 1 in the same manner as in the fifth embodiment.

Figure 27C:
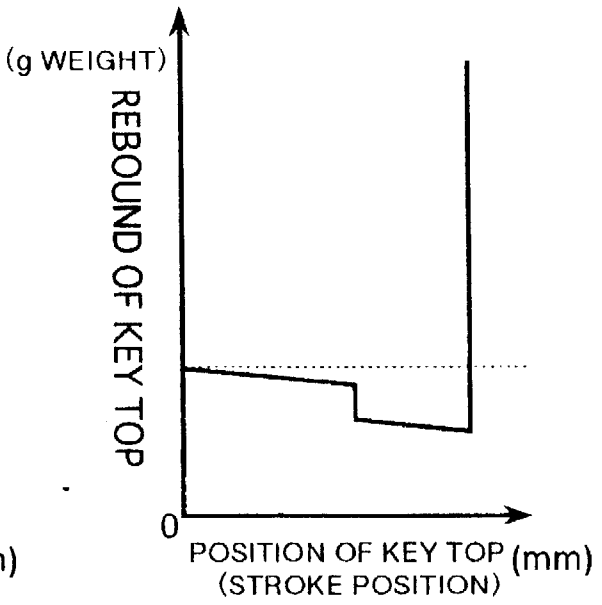
FIG. 27C is a chart showing an example of the ideal press-down characteristics (decreased rebound and a sense of click: negative inclination).

The present invention can provide an ideal key switch having the press-down characteristics shown in FIGS. 27A, 27B and 27C. Accordingly, it is possible to obtain key stroke which is more comfortable and causes little fatigue than in the prior art. Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A key switch comprising:

press-down means which is pressed down by optional force and can move in a press-down direction;

rebound generating means for generating a rebound on said press-down means according to said optional force applied to said press-down means; and press-down force generating means for generating a press-down force which resists said rebound according to a distance by which said press-down means moves, wherein said press-down force generating means is adjusted in such a manner that said rebound generated by said rebound generating means is constant irrespective of a distance by which said press-down means moves.

2. A key switch comprising:

press-down means which is pressed down by optional force and can move in a press-down direction;

rebound generating means for generating a rebound on said press-down means according to said optional force applied to said press-down means;

press-down force generating means for generating a press-down force which resists said rebound according to a distance by which said press-down means moves;

wherein said press-down means includes a key top, a slider portion which extends to a central lower portion of said key top, and an elastic member fixed to said slider portion;

said press-down force generating means includes an opening for receiving said slider portion of said press-down means, said opening having a part of an internal wall formed by an inclined face which is increased in a press-down direction of said press-down means; and said elastic member internally comes into contact with said opening and generates a force which pushes said internal wall of said opening in a direction almost perpendicular to said press-down direction.

3. The key switch as defined in claim 2, wherein said elastic member includes a compression spring and caps attached to both ends of said compression spring, said caps extending from said slider portion.

4. The key switch as defined in claim 2, wherein said elastic member is any one of a leaf spring and a torsion spring.

5. The key switch as defined in claim 2, wherein said press-down force generating means has a concave portion which surrounds said internal wall of said opening, said concave portion being approximately zig-zag shaped and said elastic member internally comes into contact with said opening in said concave portion, and said press-down force generating means rotates when said press-down means is pressed down so that said elastic member fixed to said slider portion moves in said press-down direction.

6. A key switch comprising:

press-down means which is pressed down by optional force and can move in a press-down direction;

rebound generating means for generating a rebound on said press-down means according to said optional force applied to said press-down means;

press-down force generating means for generating a press-down force which resists said rebound according to a distance by which said press-down means moves;

wherein said press-down means includes, in a lower portion thereof, an inclined side having an outer diameter which is increased in said press-down direction of said press-down means and said press-down force generating means includes a key fixing member having an opening with an inner diameter which is constant in parallel with said press-down direction and in which said press-down means is inserted, and a second elastic member which is attached to said key fixing member and which externally comes into contact with said inclined side of said press-down means to generate a force which pushes said inclined side in a direction almost perpendicular to said press-down direction.

7. The key switch as defined in claim 6, wherein said press-down force generating means is adjusted in such a manner that said rebound generated by said rebound generating means is constant irrespective of a distance by which said press-down means moves.

8. The key switch as defined in claim 6, wherein said press-down force generating means is adjusted in such a manner that said rebound generated by said rebound generating means is decreased according to a distance by which said press-down means moves.

9. The key switch as defined in claim 6, wherein said press-down force generating means is adjusted in such a manner that said rebound generated by said rebound generating means is decreased according to a distance by which said press-down means moves and a rate of decrease in said rebound is varied so that a predetermined position to which said press-down means moves is also varied.

10. The key switch as defined in claim 2, wherein said press-down force generating means is adjusted in such a manner that said rebound generated by said rebound generating means is decreased according to a distance by which said press-down means moves.

11. The key switch as defined in claim 2, wherein said press-down force generating means is adjusted in such a manner that said rebound generated by said rebound generating means is decreased according to a distance by which said press-down means moves and a rate of decrease in said rebound is varied so that a predetermined position to which said press-down means moves is also varied.

* * * * *